US009028229B2

(12) United States Patent
Bolt et al.

(10) Patent No.: US 9,028,229 B2
(45) Date of Patent: May 12, 2015

(54) WELLBORE FLUID REMOVAL SYSTEMS AND METHODS

(76) Inventors: David Joseph Bolt, Duncansville, PA (US); Kenneth Ray Newman, Willis, TX (US)

( * ) Notice: Subject to any disclaimer, the term of this patent is extended or adjusted under 35 U.S.C. 154(b) by 681 days.

(21) Appl. No.: 13/199,662

(22) Filed: Sep. 3, 2011

(65) Prior Publication Data

US 2012/0076668 A1 Mar. 29, 2012

Related U.S. Application Data

(60) Provisional application No. 61/384,981, filed on Sep. 21, 2010.

(51) Int. Cl.

| | |
|---|---|
| ***F04B 47/12*** | (2006.01) |
| ***F04B 53/00*** | (2006.01) |
| ***F04B 47/08*** | (2006.01) |
| ***F04B 15/02*** | (2006.01) |

(52) U.S. Cl.

CPC ..... *F04B 47/08* (2013.01); *F04B 15/02* (2013.01); *F04B 47/12* (2013.01)

(58) Field of Classification Search

CPC ..... F04B 15/02; F04B 47/12; F04B 47/08; F04B 53/00

USPC ..... 417/423.3, 501, 523, 555.2; 166/105.1–105.4

See application file for complete search history.

(56) References Cited

U.S. PATENT DOCUMENTS

| | | | | |
|---|---|---|---|---|
| 2,061,865 | A | 11/1936 | Wells | |
| 2,080,622 | A | 5/1937 | McMahon | 166/105.5 |
| 2,580,331 | A * | 12/1951 | Teetor | 166/68.5 |
| 2,818,818 | A * | 1/1958 | Pleuger et al. | 166/105.4 |
| 3,227,086 | A | 1/1966 | Haworth, Jr. et al. | |
| 4,275,997 | A | 6/1981 | Woodring et al. | 417/218 |
| 4,403,919 | A | 9/1983 | Stanton et al. | 417/53 |
| 4,485,876 | A | 12/1984 | Speller | 166/373 |
| 4,738,599 | A | 4/1988 | Shilling | 417/400 |
| 5,339,905 | A | 8/1994 | Dowker | 166/369 |
| 5,431,229 | A * | 7/1995 | Christensen | 166/369 |
| 5,494,102 | A | 2/1996 | Schulte | 166/105.6 |
| 5,941,311 | A * | 8/1999 | Newton | 166/369 |
| 6,145,590 | A * | 11/2000 | Havard | 166/105.2 |
| 6,155,803 | A * | 12/2000 | Curington et al. | 417/383 |
| 6,382,321 | B1 | 5/2002 | Bates et al. | 166/372 |
| 6,629,566 | B2 | 10/2003 | Liknes | 166/372 |
| 7,789,131 | B2 | 9/2010 | Gaudette | 166/72 |
| 7,874,367 | B2 | 1/2011 | Simmons | 166/369 |
| 7,909,589 | B2 * | 3/2011 | Williams | 417/430 |
| 7,954,547 | B2 | 6/2011 | Lowe et al. | 166/250.15 |

(Continued)

FOREIGN PATENT DOCUMENTS

| | | |
|---|---|---|
| CA | 2067896 | 11/1993 |

*Primary Examiner* — Peter J Bertheaud

*Assistant Examiner* — Dominick L Plakkoottam

(74) *Attorney, Agent, or Firm* — Guy McClung

(57) ABSTRACT

Deliquefication systems with an upper pumping section for discharging fluid pumped to it by a lower pumping section; in one aspect, for providing liquid from a wellbore to the upper section for removal of the liquid from the wellbore; and, in one aspect, such systems for dewatering a gas well. This abstract is provided to comply with the rules requiring an abstract which will allow a searcher or other reader to quickly ascertain the subject matter of the technical disclosure and is submitted with the understanding that it will not be used to interpret or limit the scope or meaning of the claims, 37 C.F.R. 1.72(b).

18 Claims, 17 Drawing Sheets

(56) References Cited

U.S. PATENT DOCUMENTS

| | | | | |
|---|---|---|---|---|
| 7,980,311 | B2 | 7/2011 | Dowling et al. | 166/301 |
| 7,984,756 | B2 | 7/2011 | Dowling et al. | 166/68 |
| 8,122,962 | B2 | 2/2012 | Croteau | 166/311 |
| 2005/0274527 | A1 | 12/2005 | Misselbrook et al. | 166/369 |
| 2006/0204359 | A1* | 9/2006 | Semple et al. | 415/170.1 |
| 2007/0154324 | A1* | 7/2007 | Williams | 417/53 |
| 2010/0209265 | A1 | 8/2010 | Dowling et al. | 417/404 |

* cited by examiner

FIG. 1E
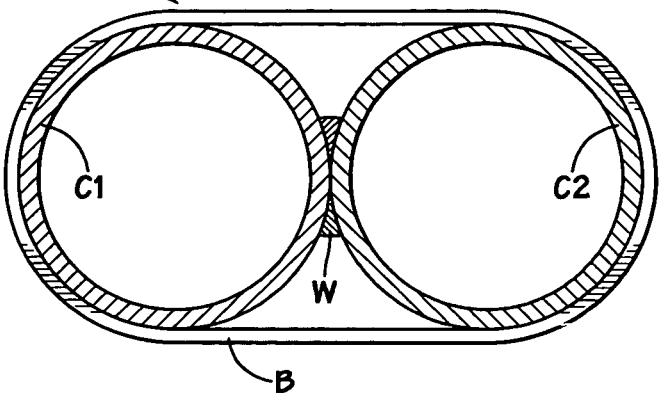
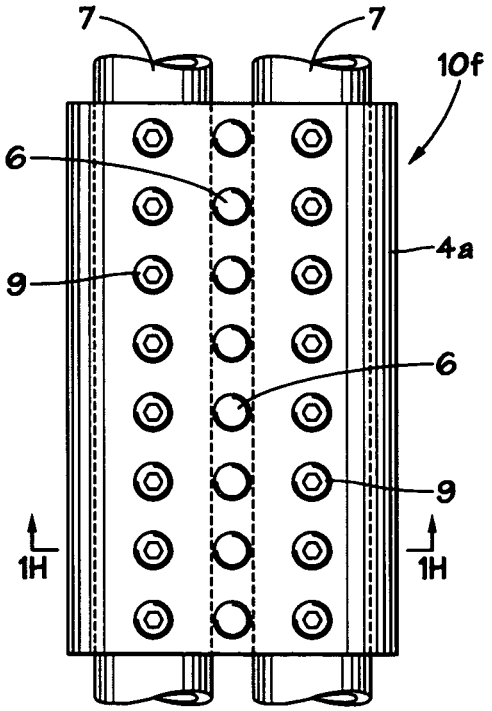
FIG. 1F
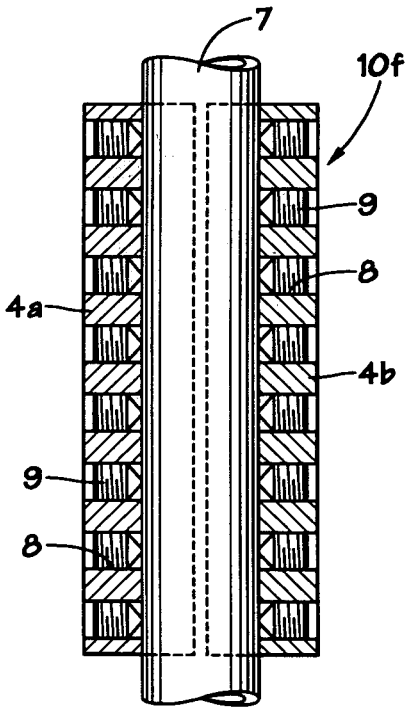
FIG. 1G
FIG. 1H
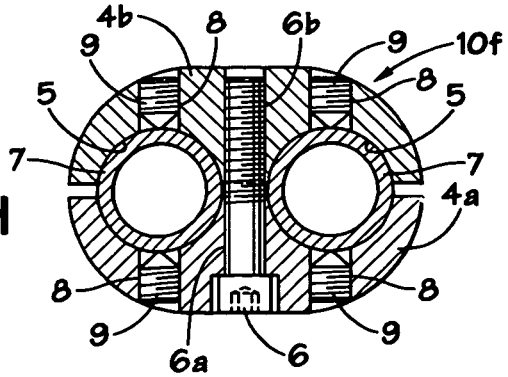

FIG. 2A
(PRIOR ART)
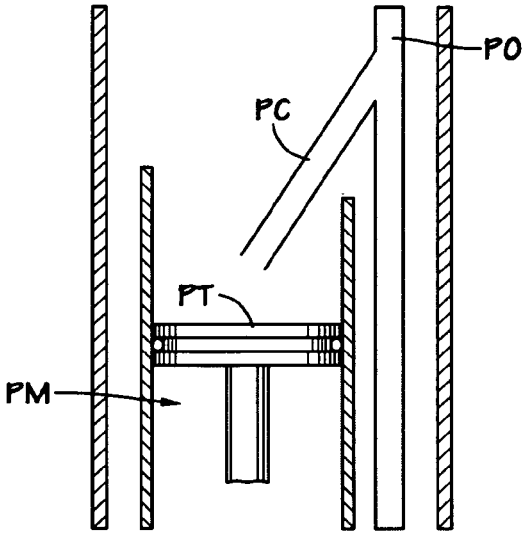
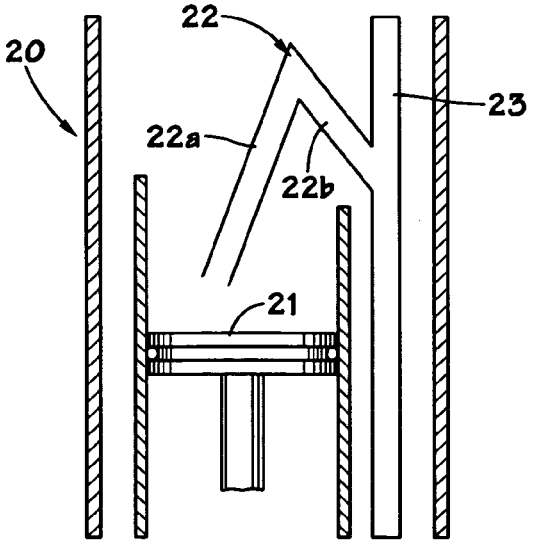
FIG. 2B
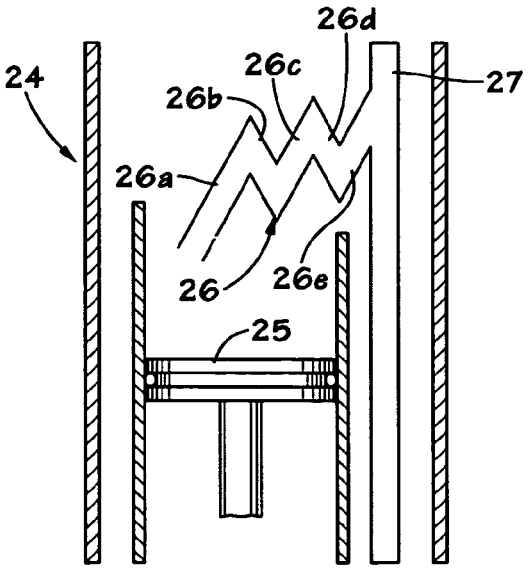
FIG. 2C

FIG. 2D
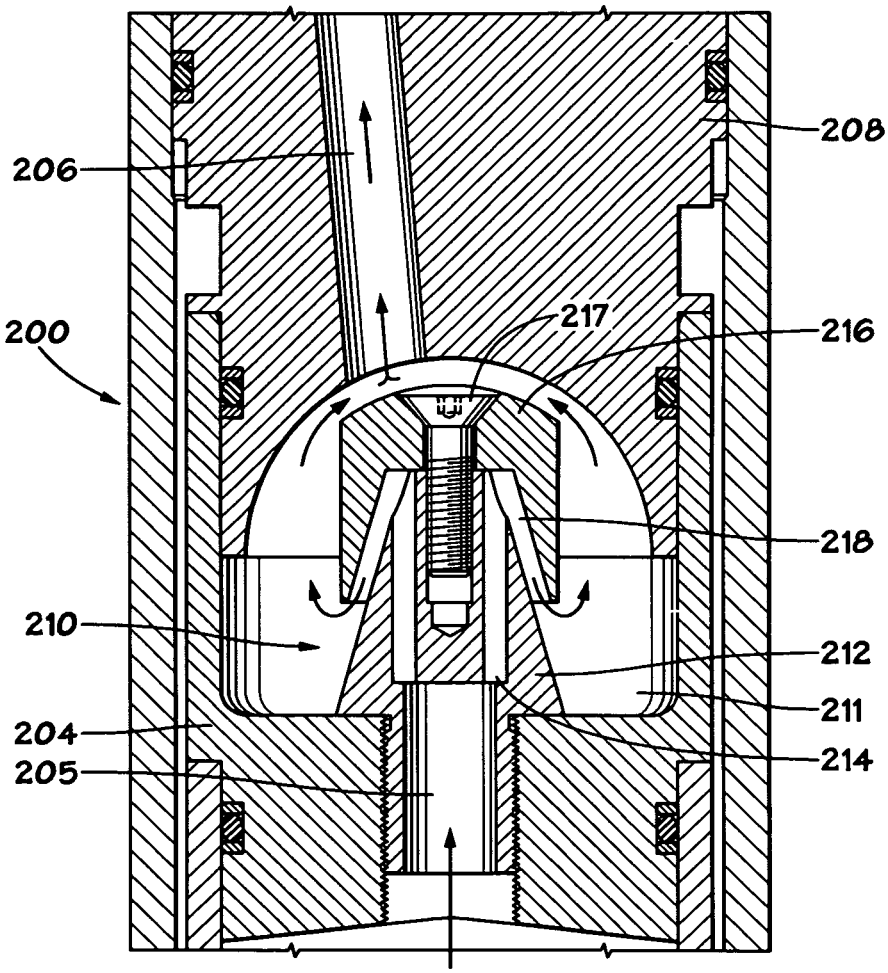
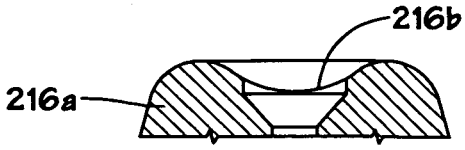
FIG. 2E

FIG. 4A
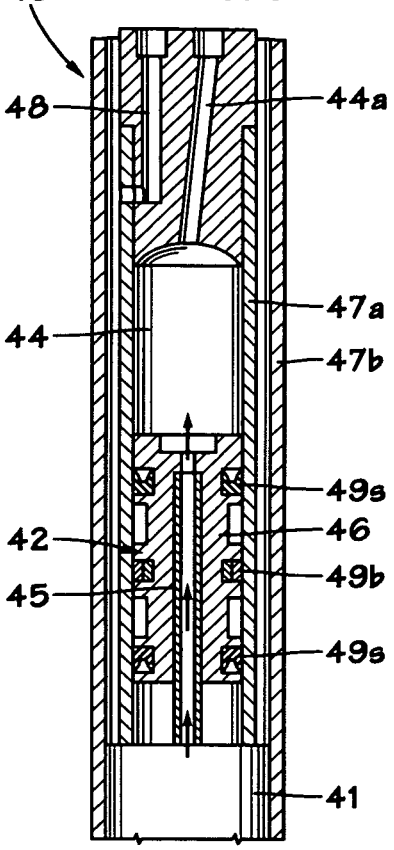
FIG. 4B
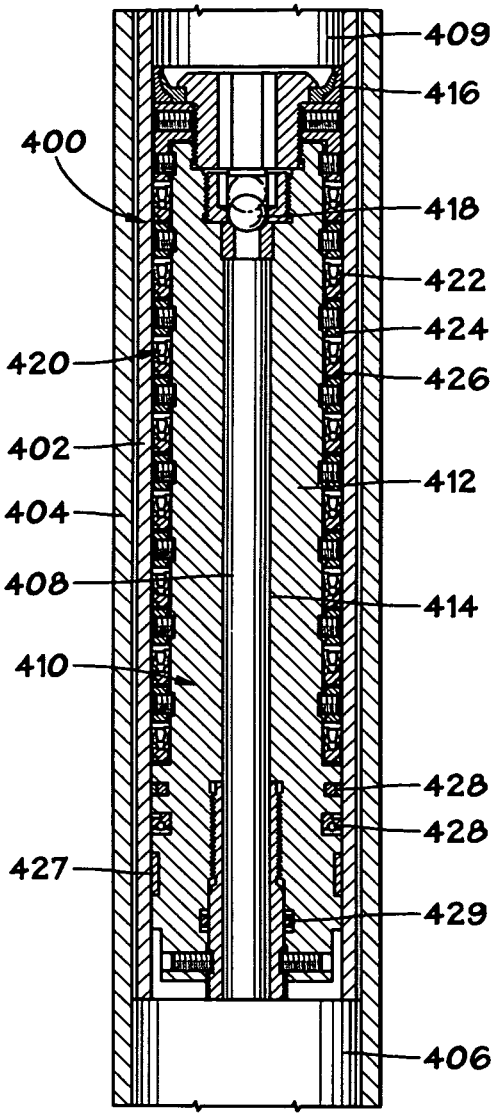
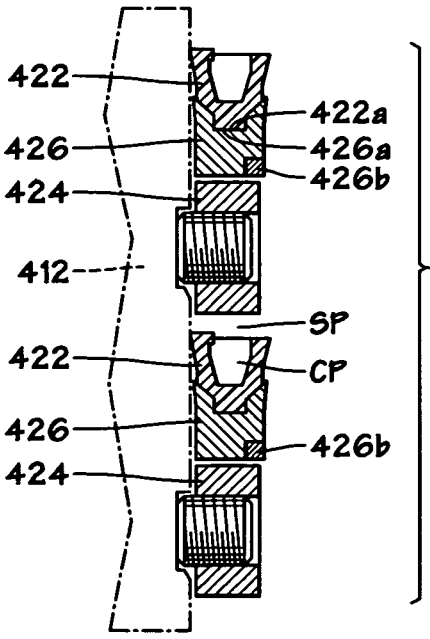
FIG. 4C
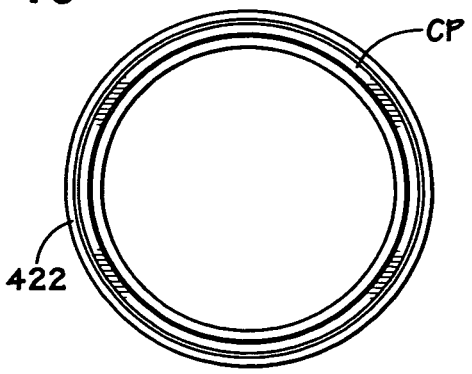
FIG. 4D

FIG. 8A

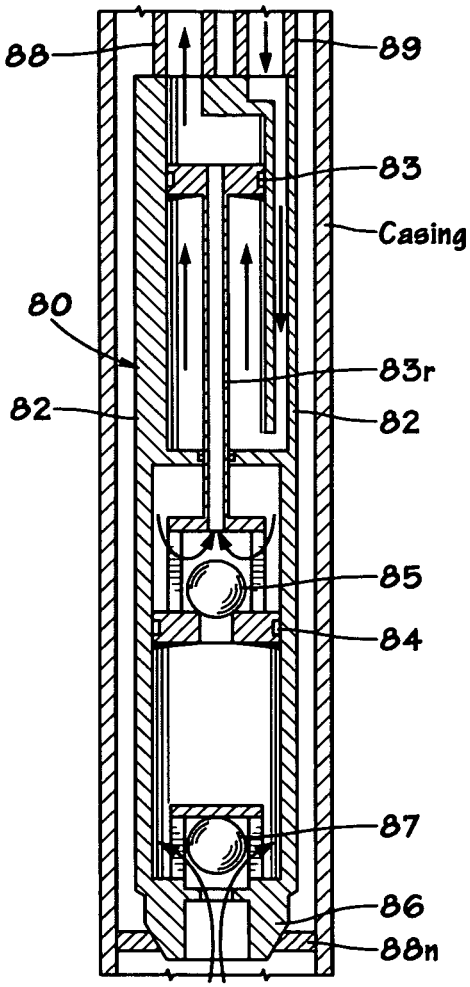

FIG. 8B

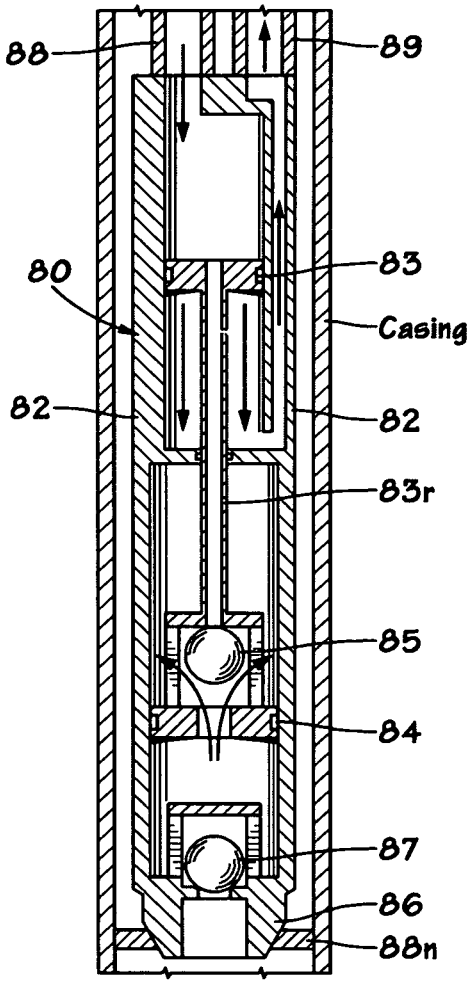

| | |
|---|---|
| Pump Outside Diameter | 3.50 in |
| Pump Stroke Length | 48 in |
| Power Piston Diameter | 2.25 to 3.00 in |
| Number of Power Pistons | 1 or 2 |
| Water Piston Diameter | 1.50 to 3.00 in |
| Two Coiled Tubing Strings, Outside Diameter | 1.25 in |
| Coiled Tubing Strings, Wall Thickness | 0.087 in |
| Specific Gravity of Produced Water | 1.01 |
| Specific Gravity of Hydraulic Fluid | 0.87 |
| Viscosity of Hydraulic Fluid at Temperature | 15 cSt |
| Maximum Hydraulic Pressure of Hydraulic Power Unit | 3000 psi |

FIG. 8C

FIG. 9A

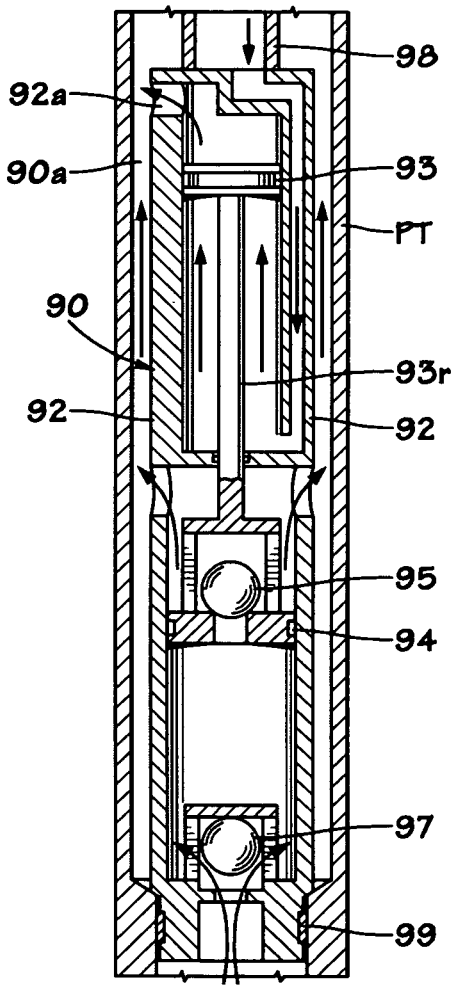

FIG. 9B

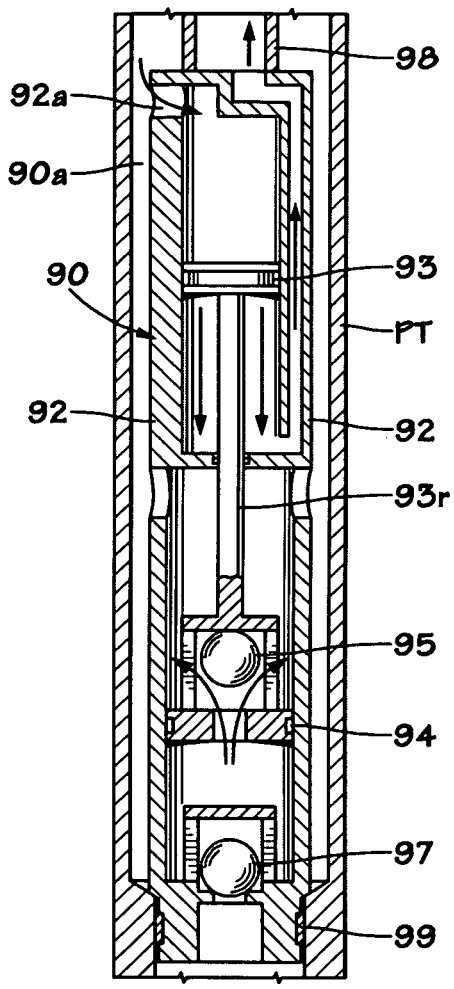

| | |
|---|---|
| Pump Outside Diameter | 1.75 in |
| Pump Stroke Length | 48 in |
| Power Piston Diameter | 1.25 in |
| Number of Power Pistons | 1 or 2 |
| Water Piston Diameter | 1.25 or 1.50 in |
| Coiled Tubing Outside Diameter | 1.25 in |
| Coiled Tubing Wall Thickness | 0.087 in |
| Production Tubing Internal Diameter | 1.99 in |
| Specific Gravity of Produced Water | 1.01 |
| Specific Gravity of Hydraulic Fluid | 0.87 |
| Viscosity of Hydraulic Fluid at Temperature | 15 cSt |
| Maximum Hydraulic Pressure of Hydraulic Power Unit | 3000 psi |

FIG. 9C

FIG. 10A
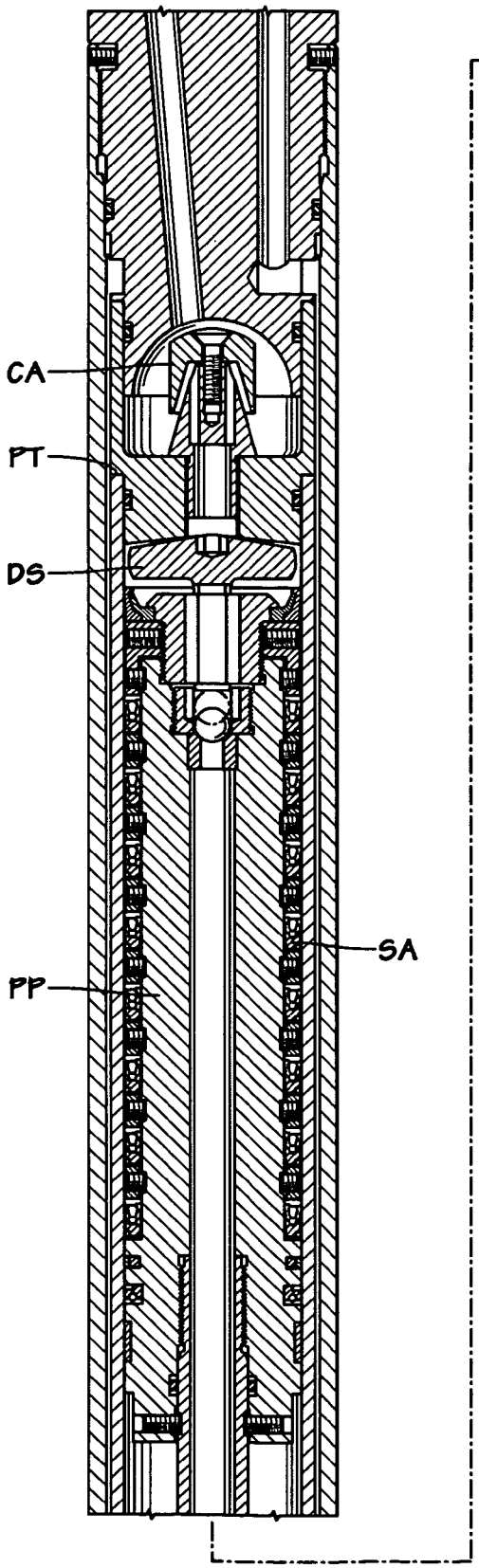
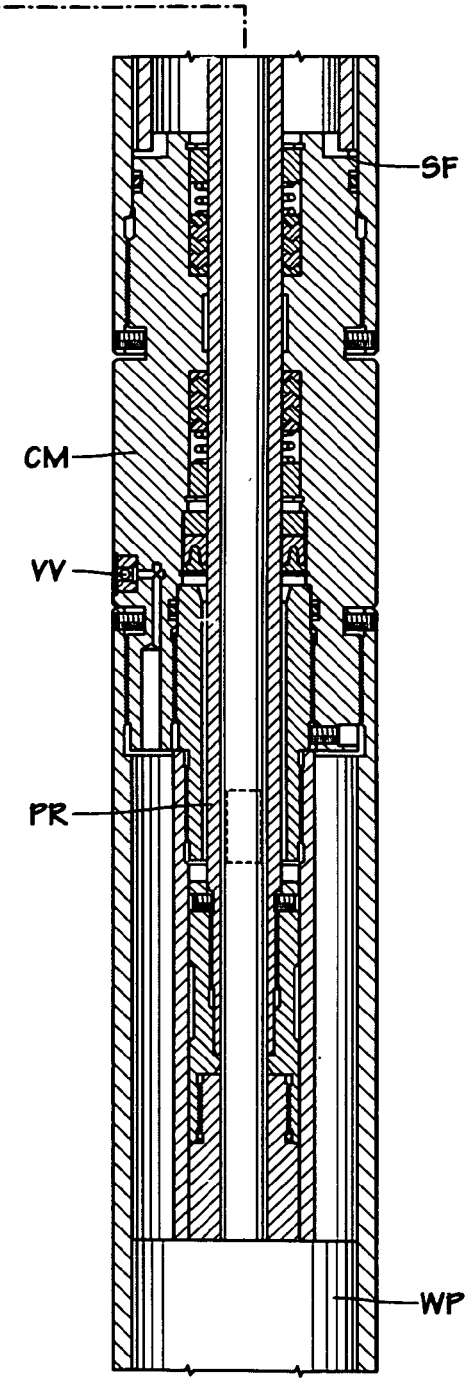
FIG. 10B

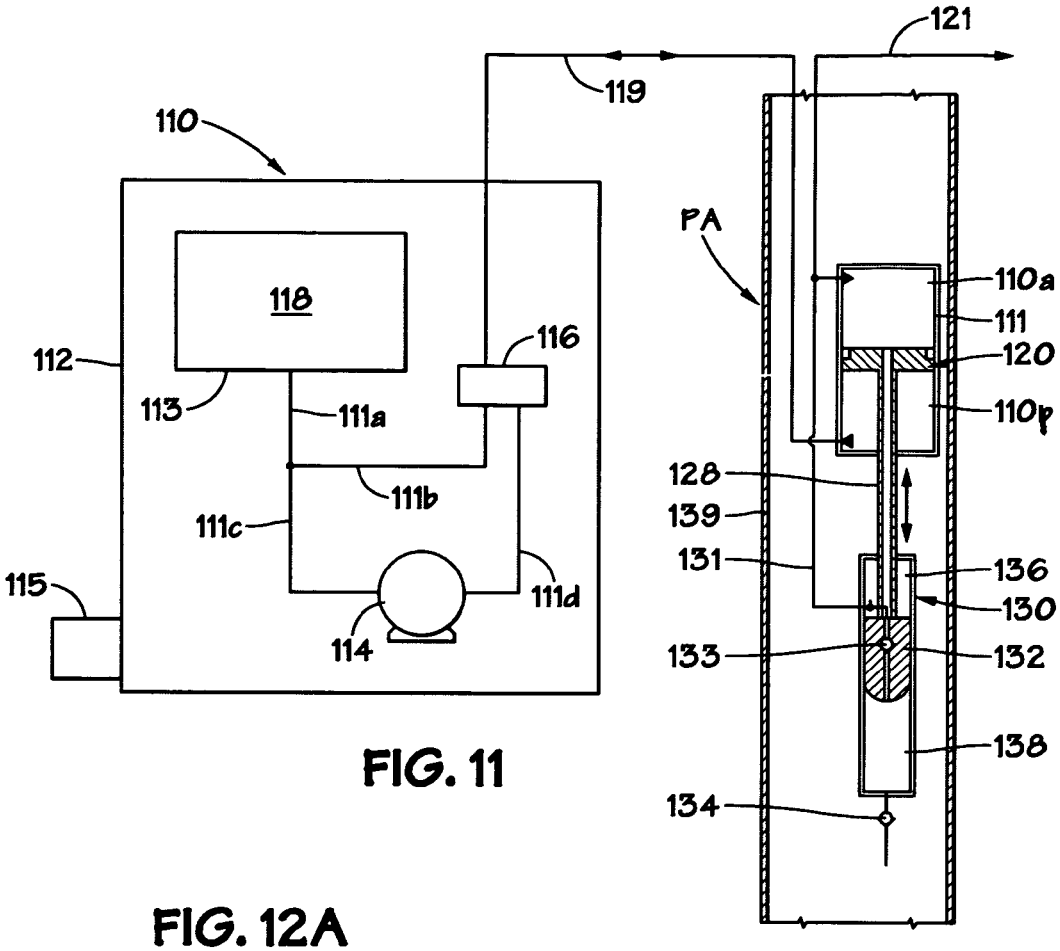
FIG. 11
FIG. 12A
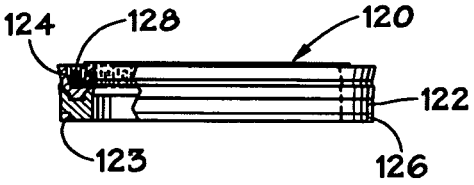
FIG. 12B
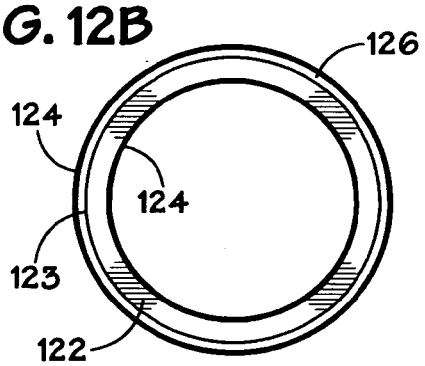
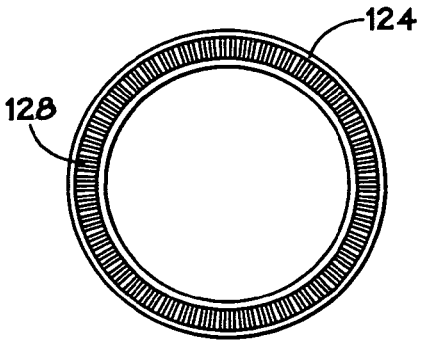
FIG. 12C
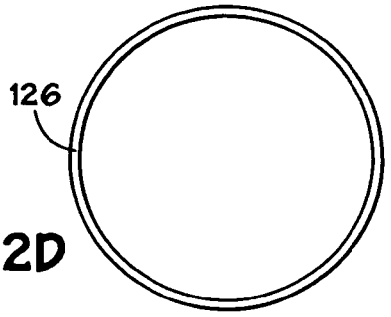
FIG. 12D FIG. 12E
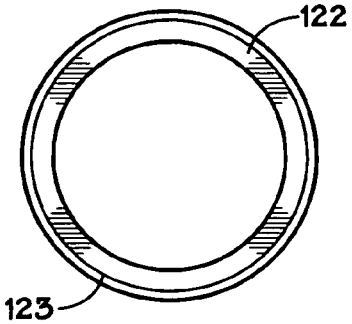
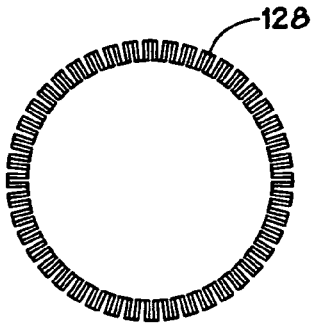
FIG. 12F
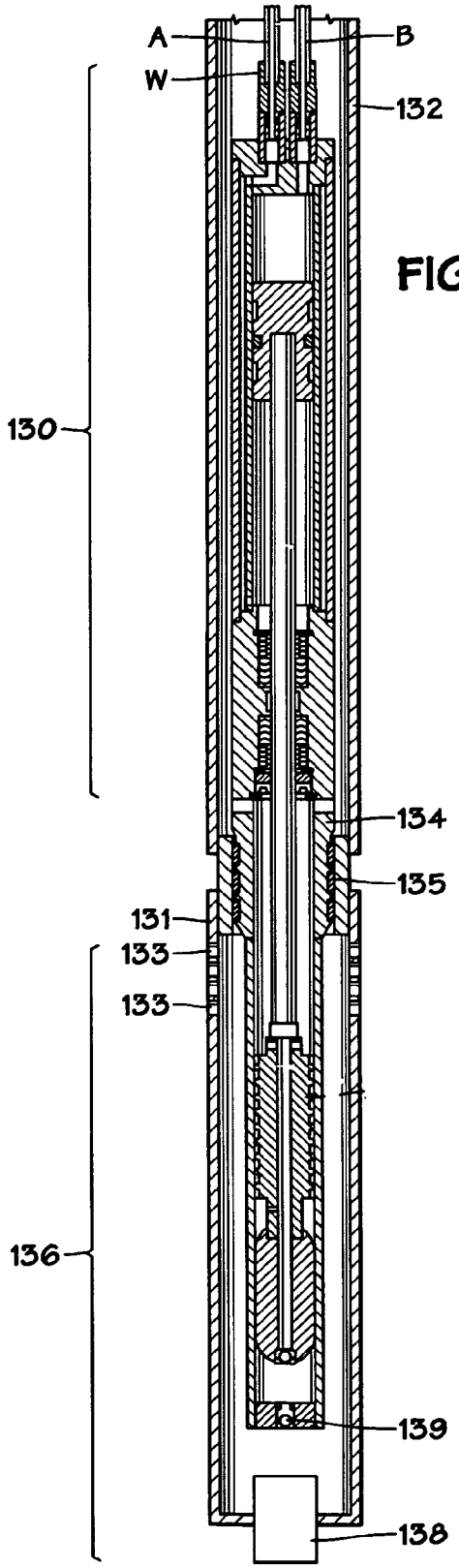
FIG. 13

WELLBORE FLUID REMOVAL SYSTEMS AND METHODS

CROSS REFERENCE TO RELATED APPLICATION

This invention and this application claim the benefit of, and claim priority from, U.S. Patent Application Ser. No. 61/384,981 filed Sep. 21, 2010, incorporated fully herein for all purposes.

BACKGROUND OF THE INVENTION

1. Field of the Invention

This present invention is directed to systems and methods for removing fluid, e.g. wellbore fluids, water, etc. from a wellbore; to such systems and methods for removing fluid from wells; to such systems and methods for deliquefying, e.g. dewatering, natural gas wells; to hydraulic pump systems for deliquefying a well, and, in certain particular aspects, to pump systems with tubular elongation isolation, inhibition of contamination by solids, flow diffusion, seal enhancement and redundancy, and/or gas build-up release; to such systems that are "power down" systems; and to methods employing such a pump system.

2. Description of Related Art

A variety of systems and apparatuses are known for removing liquid from wells; including, but not limited to, systems for removing produced fluids from wells and for removing inflowing water with solids from producing wells, e.g., from gas wells. Such systems and apparatuses include those disclosed in these exemplary U.S. patents and applications: U.S. Pat. Nos. 2,580,331; 3,227,086; 4,403,919; 4,738,599; 4,485,876; 5,339,905; 6,629,566; 7,789,131; 7,874,367; 7,954,547; and U.S. application Ser. Nos. 12/372,962 filed 18 Feb. 2009; 12/388,098 filed 18 Feb. 2009; and 12/388,542 filed 19 Feb. 2009—all of which are incorporated fully herein by reference for all purposes.

Various known downhole pumping systems employ a production fluid conduit and another conduit for conducting a power fluid, e.g. hydraulic fluid, to a downhole pumping system. During the application of power fluid, high pressure is applied to the power fluid conduit for a period of time, and then this pressure ceases. Downhole at the pump location, the fluid conduits experience the pressure due to the column of fluid above the pump. An increase in pressure on the power fluid line causes the power fluid conduit to expand and strain, both diametrically and axially. The axial expansion increases or elongates the overall length of the power fluid conduit, e.g. in some wells about ten feet of expansion between the surface and the pump. The other fluid conduit, e.g. a conduit for the evacuation of produced fluid from the well, does not expand as much as the hydraulic fluid conduit and the differential in these expansions produces movement of the power fluid conduit with respect to the production fluid conduit which can cause wear problems and helixing or corkscrewing of the conduits. This can result in apparatuses being stuck in a well and in the failure of a pumping system.

BRIEF SUMMARY OF THE INVENTION

The present invention, in certain aspects, discloses systems and methods for removing fluid from a wellbore which employ a pumping system according to the present invention and which, in certain particular aspects, is a gas well dewatering system.

The present invention, in certain aspects, discloses systems and methods for removing fluid from a wellbore which employ an elongation isolation apparatus used with the two conduits. The isolation apparatus, located above the pumping system and applied to the two conduits, isolates the pumping system components below the isolation apparatus from the effects of the differential pressures and the ensuing movement of the expanding line.

In one particular aspect, the isolation apparatus is connection structure or material that mechanically connects two flow lines together so that a pump apparatus located below the connection structure is isolated from growth or elongation of one or both flow lines. In another particular embodiment, an isolation apparatus includes two opposed halves which are bolted together to clamp around both lines and, in one other aspect, the halves are secured to the lines themselves with set screws.

In certain embodiments of systems and methods according to the present invention, a pumping system includes a contraflow apparatus in which fluid pumped up from a wellbore has solids in it (e.g., drilled cuttings, silt, debris, etc.) and the contraflow apparatus inhibits the solids, which have been pumped up within the pumping system, from flowing into components of the system.

In certain aspects, a contraflow apparatus according to the present invention includes a contraflow portion or portions of a flow path in which fluid with solids which is initially flowing up flows down; and, in one aspect, fluid which initially is flowing upwardly and which then attempts to flow back down towards the wellbore pumping system, flows upwardly within the contraflow apparatus such that solids within the fluid are inhibited from flowing up and tend to settle within or near a portion of the flow path rather than flow on down to the pumping system.

Thus, the solids which settle in or near the contraflow portion do not flow back down within the apparatus and do not return to the pumping system. In certain aspects, as these solids build up, they form a solids barrier or dam which inhibits further solids from passing down to the system components.

In certain embodiments of systems and methods according to the present invention, fluid with solids therein is pumped by a wellbore pumping system which has a piston with a piston top and the fluids with solids are pumped into a chamber above the piston top. To inhibit the flow of the fluid with solids back down to an interface between the piston's exterior and another surface of the pumping system, an excluder is used at the top of the piston.

According to the present invention, to enhance the operation of the excluder, a high velocity flow area or "venturi area" is created in certain embodiments above the top of the piston. This venturi area is defined by part of a diffuser and by part of seal apparatus for the top of the piston and it is sized and configured to provide a high velocity flushing action which washes solids away from the excluder and thereby away from seals, inhibiting return of the solids to the interface which includes the piston's exterior. Such a structure may also create a lower pressure area adjacent seal structure resulting in longer seal life.

The present invention provides, in certain embodiments, a wellbore pumping system in which the pumping system has a pumping piston which moves within a tubular, in certain aspects referred to as a "barrel". A seal assembly according to the present invention seals an interface between the exterior of the piston and the interior of the barrel. Among other things, this seal assembly inhibits the passage of fluid and of solids into the interface. In certain aspects, the seal assembly includes a plurality of seals one on top of the other so that when a first top seal wears and no longer provides sufficient sealing, a next seal below the top seal does provide the desired sealing, and so on as an upper seals wears and a next lower seal seals the interface.

In certain embodiments of such systems according to the present invention, a seal assembly according to the present invention includes a plurality of spacers with a spacer between each pair of seals. The spacers prevent adjacent seals from loading each other and, in one aspect, each spacer has a projection which is disposed in a corresponding recess to assist in maintaining desired seal location.

In certain embodiments of such systems according to the present invention, a seal assembly according to the present invention includes a plurality of backup structures with a backup structure beneath and in contact with each seal. The backup structures: support the seals prolonging useful seal life; act as a bearing for the piston (e.g. when made as desired from any known suitable bearing material, e.g., but not limited to, polytetrafluoroethylene); inhibit extrusion of the seals as the seals wear and thereby inhibit undesirable piston wobbling; serve, when made of appropriate material, as the provider of lubricant for facilitating movement of the piston on the interior surface of the barrel; and/or reduce sliding friction of the seal thus prolonging seal life.

In certain embodiments the present invention provides a wellbore pumping system with a gas trap extension located below a lower pump inlet for trapping gas flowing into the pump system from the formation in which the wellbore is located. Such gas can prevent fluid, e.g. wellbore fluid and/or water, from getting to the pump inlet which can inhibit effective pumping action.

The present invention provides such a gas trap with a vent valve which opens when gas pressure within the gas trap reaches a predetermined level (e.g., but not limited to the pressure of about two feet of water column or to less than one psi) thereby allowing the gas to bleed out and exit from within the gas trap and preventing the gas from getting to the pump inlet.

In certain aspects, the present invention provides a pumping system in which a barrel housing a power piston is preloaded during system assembly against an outer barrel within which the inner barrel is disposed so that when the outer barrel expands or grows, the inner barrel is in compression to the extent of the growth of the outer barrel. This reduces or minimizes fatigue failure and damage to threads of the outer barrel. This preloading reduces or prevents differential movement of the inner barrel and maintains the inner barrel in axial compression thus prolonging barrel life and inhibiting or preventing inner barrel movement and thereby reducing or eliminating problems associated with such movement.

In certain aspects, the present invention provides "power down" systems in which power fluid is applied to a top of a power piston.

The present invention, in certain aspects, provides a pump system for pumping fluid, the fluid containing solids the system including: a pump section with a fluid pump having a movable pump plunger for pumping fluid; a discharge section with a discharge pump for receiving fluid pumped by the fluid pump, the discharge pump for pumping the fluid out from the pump system, the discharge pump being a single acting pump or a double acting pump; the discharge pump having a pump barrel with an interior surface and a pumping piston with a sealing system with one seal or with multiple seals; the pumping piston movable in the pump barrel and having a top; a diffuser for facilitating fluid flow past the sealing system of the pumping piston; a plugging prevention system which receives pumped fluid with solids therein and which has a flow path oriented to inhibit solids flow down to the discharge pump; and pressure apparatus for returning the pumping piston and the pump plunger. Such a system may have one or some, in any possible combination, of the other aspects and features of pumping systems disclosed herein according to the present invention.

Accordingly, the present invention includes features and advantages which are believed to enable it to advance pump technology and wellbore dewatering technology. Characteristics and advantages of the present invention described above and additional features and benefits will be readily apparent to those skilled in the art upon consideration of the following detailed description of preferred embodiments and referring to the accompanying drawings. What follows are some of, but not all, the objects of this invention. In addition to the specific objects stated below for at least certain preferred embodiments of the invention, there are other objects and purposes which will be readily apparent to one of skill in this art who has the benefit of this invention's teachings and disclosures. It is, therefore, an object of at least certain preferred embodiments of the present invention to provide:

New, useful unique, efficient, nonobvious systems and methods for deliquefying a wellbore.

Such new, useful, unique, efficient, nonobvious systems and methods with backed-up seals with prolonged seal life.

Such new, useful unique, efficient, nonobvious systems and methods in which a contraflow structure inhibits or prevents solids in pumped fluid which is being pumped upwardly from flowing down to apparatuses, equipment, valves, systems and pumps.

New, useful unique, efficient, nonobvious systems and methods for deliquefying a wellbore in which an excluder with a diffuser is used to create a high velocity flow area above the top of a fluid pumping piston to provide a flushing action to wash solids away and thereby to inhibit solids which have an adverse on seals of the system.

Such systems and methods with a multi-barrel assembly that houses a pumping piston in which an inner barrel is preloaded in compression with respect to the outer barrel so that growth or elongation of the outer barrel does not adversely affect the inner barrel.

Such systems and methods with a "power down design" in which power fluid is applied to the top of a power piston; and Such new, useful unique, efficient, nonobvious systems and methods in which water is usable as a power fluid.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention and its diverse embodiments recognize and address the long-felt needs and provides a solution to problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of certain preferred embodiments, given for the purpose of disclosure, when taken in conjunction with the accompanying drawings.

The detail in these descriptions is not intended to thwart this patent's object to claim this invention no matter how others may later disguise it by variations in form, changes, or additions of further improvements.

It will be understood that the various embodiments of the present invention may include one, some, or any possible combination of the disclosed, described, and/or enumerated features, aspects, and/or improvements and/or technical advantages and/or elements in claims to this invention.

BRIEF DESCRIPTION OF THE SEVERAL VIEWS OF THE DRAWING

A more particular description of embodiments of the invention briefly summarized above may be had by references to the embodiments which are shown in the drawings which form a part of this specification.

These drawings illustrate embodiments preferred at the time of filing for this patent and are not to be used to improperly limit the scope of the invention which may have other equally effective or legally equivalent embodiments.

FIG. 1E is a cross-section view of a system according to the present invention.

FIG. 1F is a side view of a clamp apparatus according to the present invention.

FIG. 1G is a cross-section view of the clamp apparatus of FIG. 1F.

FIG. 1H is a cross-section view along line 1H-1H of FIG. 1F.

FIG. 2A is a schematic cross-section view of part a prior art system.

FIG. 2B is a schematic cross-section view of a system according to the present invention.

FIG. 2C is a schematic cross-section view of a system according to the present invention.

FIG. 2D is a cross-section view of a system according to the present invention with a solids dam structure according to the present invention.

FIG. 2E is a cross-section view of a dam cap for a system according to the present invention with a solids dam structure according to the present invention.

FIG. 4A is a cross-section partially schematic view of a system according to the present invention.

FIG. 4B is a cross-section partially schematic view of a system according to the present invention.

FIG. 4C is an enlargement of part of a seal assembly of the system of FIG. 4B.

FIG. 4D is a bottom view of a seal of the seal assembly of FIG. 4C.

FIG. 8A is a schematic view of an up stroke step in a method according to the present invention with a well liquid removal system according to the present invention.

FIG. 8B is a schematic view of a step subsequent to the step shown in FIG. 8A according to the present invention.

FIG. 8C presents a table with data for one embodiment of a system like the system of FIG. 8A.

FIG. 9A is a schematic view of an up stroke step in a method according to the present invention with a well liquid removal system according to the present invention.

FIG. 9B is a schematic view of a step subsequent to the step shown in FIG. 8A according to the present invention.

FIG. 9C presents a table with data for one embodiment of a system like the system of FIG. 8A.

FIG. 10A is an enlargement of part of the system of FIG. 10.

FIG. 10B is an enlargement of part of the system of FIG. 10.

FIG. 11 is a schematic view of a well liquid removal system with a pump system according to the present invention.

FIG. 12A is a side view of a seal useful with pistons in systems according to the present invention.

FIG. 12B is a bottom view of the seal of FIG. 12A.

FIG. 12C is a top view of a cup member of the seal of FIG. 12A.

FIG. 12D is a top view of a ring of the seal of FIG. 12A.

FIG. 12E is a bottom view of a base of the seal of FIG. 12A.

FIG. 12F is top view of a support member of the cup of the seal of FIG. 12A.

FIG. 13 is side cross-section schematic view of a system according to the present invention.

Figure 1A:
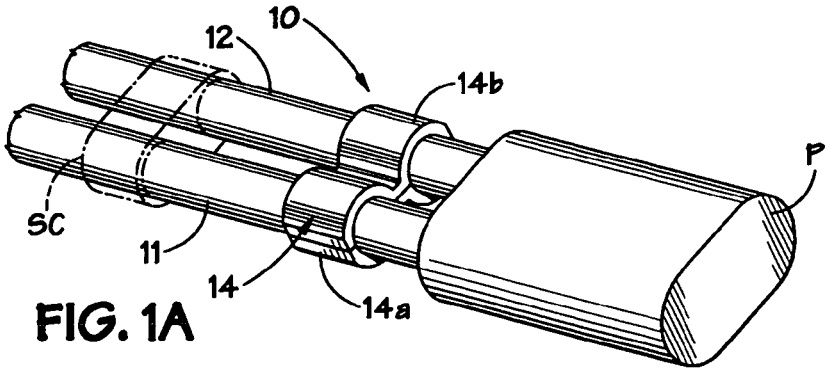
FIG. 1A is a perspective view of a system according to the present invention.

Certain embodiments of the invention are shown in the above-identified figures and described in detail below. Various aspects and features of embodiments of the invention are described below. Any combination of aspects and/or features described below can be used except where such aspects and/or features are mutually exclusive. It should be understood that the appended drawings and description herein are of certain embodiments and are not intended to limit the invention. On the contrary, the intention is to cover all modifications, equivalents and alternatives falling within the spirit and scope of the invention as defined by the appended claims.

In showing and describing these embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof mean one or more embodiments, and are not intended to mean the claimed invention of any particular embodiment. Accordingly, the subject or topic of each such reference is not automatically or necessarily part of, or required by, any particular embodiment. So long as they are not mutually exclusive or contradictory any aspect or feature or combination of aspects or features of any embodiment disclosed herein may be used in any other embodiment disclosed herein.

The present invention includes a variety of aspects, which may be combined in different ways. The following descriptions are provided to list elements and describe some of the embodiments of the present invention, including those preferred at the time of filing for this patent. These elements are listed with initial embodiments, however it should be understood that they may be combined in any manner and in any number to create additional embodiments.

The variously described examples and preferred embodiments should not be construed to limit the present invention to only the explicitly described systems, techniques, methods and applications. Further, this description should further be understood to support and encompass descriptions and claims of all the various embodiments, systems, techniques, methods, devices, and applications with any number of the disclosed elements, with each element alone, and also with any and all various possible permutations and combinations of all elements in this or any subsequent application.

DETAILED DESCRIPTION OF THE INVENTION

FIG. 1A shows a system 10 according to the present invention that has a downhole pumping apparatus P, shown schematically, and two lines 11 and 12 for fluid flow with respect to the apparatus P. In one aspect the two lines 11 and 12 are fixed together at each end and held together by a plastic sleeve along the entire length of the lines.

In certain aspects, fluid pressure in one of the lines, e.g. line 11, can cause the line 11 to elongate with respect to line 12. The line 11, since it is fixed to the line 12, can, with sufficient elongation or growth, move and spiral around the line 12. The system 10 isolates the pumping apparatus from the effects of this elongation and movement of the line 11 with respect to the line 12. The pumping apparatus P may be any suitable known pumping apparatus or any pumping apparatus according to the present invention. In one particular aspect, hydraulic power fluid flows in the line 11 and produced fluid (e.g., but not limited to, from a wellbore) flows in the line 12.

The clamp 14 has two halves 14*a* and 14*b* which are installed around the lines 11 and 12. By clamping the line 11 to the line 12, elongation or growth of the line 11 and its possible spiraling around the line 12, are inhibited or prevented from affecting the apparatus P. The two halves are connected together with any known connector(s) (e.g. screws, rivets, bolts, releasably cooperating fastener material, staples, wrap-around material and/or band) and/or connection media (e.g. glue, adhesive, epoxy). Optionally, a second connection SC, shown in dotted line, connects the lines 11 and 12. The connection SC may be any connection structure, connector(s), connection material, and/or clamp disclosed herein.

Figure 1B:
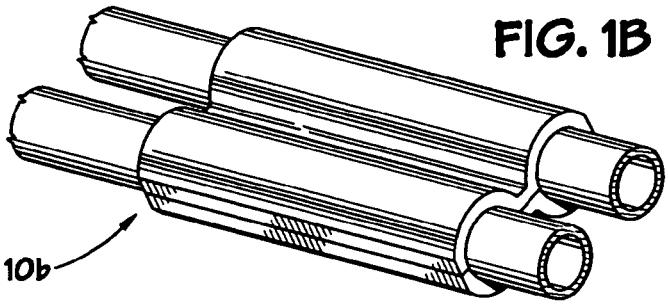
FIG. 1B is a perspective view of part of a system according to the present invention.

A clamp like the clamp 10 may be of any suitable, desirable size for a particular use and a particular pump apparatus. For example, a clamp 10*b* as shown in FIG. 1B is several times larger than the clamp 10, FIG. 1A. In each of the systems of FIGS. 1B-1D, the clamp is used with a pumping apparatus, not shown, as are the connected conduits of FIG. 1E.

Figure 1C:
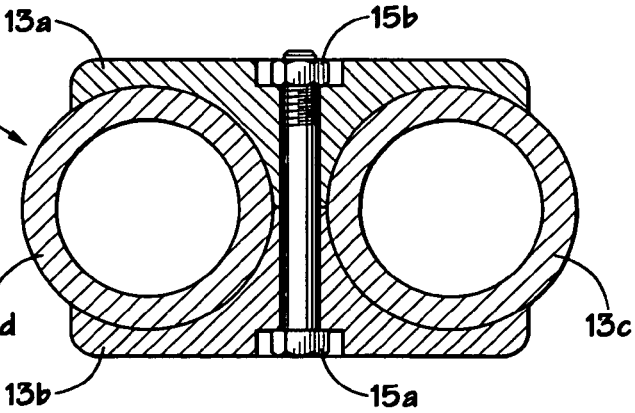
FIG. 1C is a cross-section view of a system according to the present invention.

Parts of a clamp like the clamp 10 may be connected together to clamp one line to another with connector(s) like bolts or screws. For example, a clamp 10*c* as shown in FIG. 1C has two halves 13*a* and 13*b* which are clamped to two flow lines 13*d* and 13*c* with a bolt 15*a* and a nut 15*b*. It is within the scope of the present invention to use one bolt or any desired number of blots.

Figure 1D:
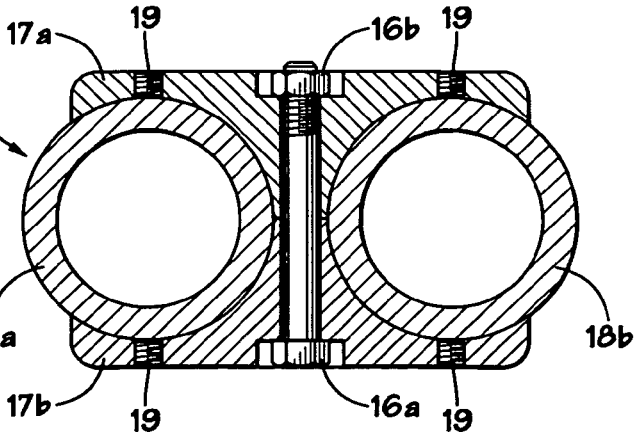
FIG. 1D is a cross-section view of a system according to the present invention.

Parts of a clamp like the clamp 10 may be secured to flow lines with any suitable known securement device and/or securement material, e.g., but not limited to, a bolt or bolts, friction increasing materials, interference structures, and/or using set screws which extend through parts of a clamp and are screwed against an exterior of a line. For example, a clamp 10*d* as shown in FIG. 1D has two halves 17*a* and 17*b* which are clamped to two lines 18*a* and 18*b* with set screws 19. Optionally, a system according to the present invention may use both set screw(s) and with bolt(s). Optionally, the clamp 10*d* includes a bolt 16*a* and a nut 16*b* for clamping the clamp 10*d* to the lines 18*a* and 18*b*. It is within the scope of the present invention to use one set screw or any desired number of such screws.

A clamp like the clamps 10, 10*b*, 10*c*, 10*d*, 10*e* and 10*f* may be of any suitable, desirable size for a particular use and a particular pump apparatus. For example, a clamp 10*b* as shown in FIG. 1B is several times larger than the clamp 10, FIG. 1A. In one aspect, an elongation isolation structure according to the present invention for two flow lines is about two feet above a pump apparatus (e.g., above the pump apparatus p, FIG. 1*a*; above the upper pump section, FIG. 5; or above the top of the body 62, FIG. 6). Any clamp according to the present invention can be made of any suitable material, including, but not limited to metal, steel, plastic, composite, and fiberglass.

FIG. 1E shows two flow conduits C1 and C2 (for example, but not limited to, a conduit C1 for the flow of produced fluid, e.g, but not limited to, water with solids therein, and a conduit C2 for the flow of hydraulic power fluid) of a system 10*e* according to the present invention.

The two flow conduits C1 and C2 are connected together by connection material W which may be any suitable known adherence material (glue, adhesive, epoxy, etc.) and/or any suitable weld or welding material appropriately applied or welded. Sufficient material is used and/or sufficient welding is done so that the two conduits are mechanically connected to isolate a pump apparatus, not shown, from elongation and/or spiraling of one of the flow conduits.

FIGS. 1F-1H show a system 10*f* according to the present invention that clamps on two flow lines 7. The system 10*f* isolates a lower pumping apparatus from the effects of elongation and movement of one line 7 with respect to the other line 7. The system 10*f* has a clamp with halves 4*a* and 4*b* which are installed around the lines 7. The lines 7 pass through channels 5 defined by the two halves 4*a* and 4*b*. The two halves are connected together with bolts 6 which extend through channels 6*a* and 6*b* in the halves 4*a* and 4*b*, respectively. Set screws 9 in corresponding channels 8 also secure the halves 4*a* and 4*b* to the lines 7.

In one aspect, a clamp is about ten inches above a pumping apparatus. In certain aspects, a clamp is located between one inch and ten inches above a pumping apparatus. In other aspects this range is between one foot and three feet or between one inch and twenty feet above a pumping apparatus.

In certain prior art pump systems, a pump has a piston which pumps fluid from a well. It is possible, in certain prior pump systems, for debris, solids, abrasives and/or particulates in pumped fluid which has not been pumped out of the pump apparatus to settle downward onto a top of a pumping piston. Such settled solids, etc. can create a variety of problems with pump operation and maintenance; for example, such sediment can abrade piston seals and can clog an upper pump chamber.

FIG. 2A illustrates a known pump PM in which produced fluid pumped by a piston PT flows up through a produced fluid conduit PC to a produced fluid outlet flow path PO. Flow throughout the conduit PC is generally upwardly and, thus, when the piston PT is not pumping produced fluid up to and then from an upper chamber PB (e.g, when fluid velocity is so low that settling of solids occurs), solids, etc. in the fluid can flow back down onto the top of the piston PT and to a sealed piston/structure interface.

According to the present invention, this problem of unwanted solids flowing down to a pump piston is addressed by providing in the produced fluid flow path a part or parts of the fluid flow path in which solids attempting to flow back down onto a pump piston must flow upwardly before moving down onto the top of the piston. The part of the flow path in which the solids must flow up before they can flow down, a "trap" area, in effect, creates a local low area or sump in which solids build up forming a solids dam which prevents solids from flowing down onto the piston. As particulates collect in and/or near the trap area, they form a solids dam which blocks the passage preventing solids from reaching a chamber of the pump piston.

FIG. 2B shows a pump system 20 according to the present invention in which a piston 21 (sometimes called a "power piston") pumps produced fluid up to a produced fluid conduit 22 which has a first section 22*a* in fluid communication with a second section 22*b*. The second section 22*b* is in fluid communication with a production flow path 23 from which pumped produced fluid exits the well. In the event the fluid velocity of fluid that flows from the flow path 23 back into the second section 22*b* is so low that solids settling occurs, the settling solids are inhibited from flowing upwardly in the section 22*b* and settle downwardly. Such solids inhibited from flowing up in the section 22*b* accumulate therein or nearby and form a barrier to other solids and prevent other solids from flowing up in the second section 22*b*, thereby inhibiting the flow of the solids back down to the top of the piston 21.

FIG. 2C illustrates that, according to the present invention, a produced fluid conduit may have more than one section in which solids would have to flow upwardly to return to the top of a pumping piston. A pump system 24 according to the present invention has a piston 25 which pumps produced fluid up to a produced fluid conduit 26. The produced fluid conduit 26 has a first section 26*a*, a second section 26*b*, a third section 26*c*, a fourth section 26*d*, and a fifth section 26*e*. Solids attempting to flow back down to the piston 25 are required to flow up in the second section 26*b* and up in the fourth section 26*d* to return to the top of the piston 25. Produced fluid is pumped from the well in a production flow path 27 which is in fluid communication with the fifth section 26*e* of the produced fluid conduit 26.

FIG. 2D shows a system 200 which is a contraflow system according to the present invention for inhibiting the flow of solids in well fluid from flowing back down to a pumping piston. A dam structure 210 within a dam mandrel 204 is interposed in a fluid flow path in which fluid flows from below the dam mandrel 204, through a dam channel 205, through the dam structure 210, and up to a flow channel 206 in a top mandrel 208 to which the dam mandrel 204 is connected. Arrows indicate the flow path from below the dam structure, through the dam channel 205, through the dam structure 210, and then into the flow channel 206 of the top mandrel 208. A pump apparatus, not shown, below the dam channel 205, with a pumping piston pumps fluid to and through the dam structure 210. The channel 206 may have parallel sides as shown or it may have sides that taper toward or away from the lower surface of the mandrel 208 (i.e., wider at the top or the bottom of the channel 206).

The dam structure 210 has a dam chamber 211 with a dam base 212 therein with a base flow channel 214 and a dam cap 216 which is connected to the base 212 with a bolt 217. Part of the dam cap 216 is spaced apart from the exterior surface of the dam base 212 forming an fluid flow path 218 through which fluid being pumped out of the system 200 flows down and out from the dam structure 210. This fluid then flows around the top of the dam cap 216 and up to the flow channel 206 of the top mandrel 208. It is within the scope of the present invention for the dam cap to have a top surface of any chosen shape and configuration, e.g. but not limited to, curved, concave, or flat; and, in one aspect, as shown, the dam cap 216 has a curved surface and the interior of the top mandrel 208 below the dam cap 216 has a curved surface that corresponds to the curve of the top of the dam cap 216. Optionally, the top of the dam cap is concave to assist in solids dam formation (see, e.g., the cap 216*a* with concave portion 216*b*, FIG. 2E).

When the pump piston is not pumping fluid in the direction as described above, any fluid with solids, etc. therein which attempts to flow back down to the piston, will flow in the reverse directions as indicated by the arrows in FIG. 2D; i.e., fluid will flow up, not down, in the fluid flow path 218 between the dam base 212 and the dam cap 216. Solids in this fluid will be inhibited from this upward flow in the flow path 218 and will accumulate forming a dam.

As shown in FIG. 2D, optionally the channel 206 may be tapered to assist in clearing an accumulation of solids or a solids dam that has been formed.

Figure 3B:
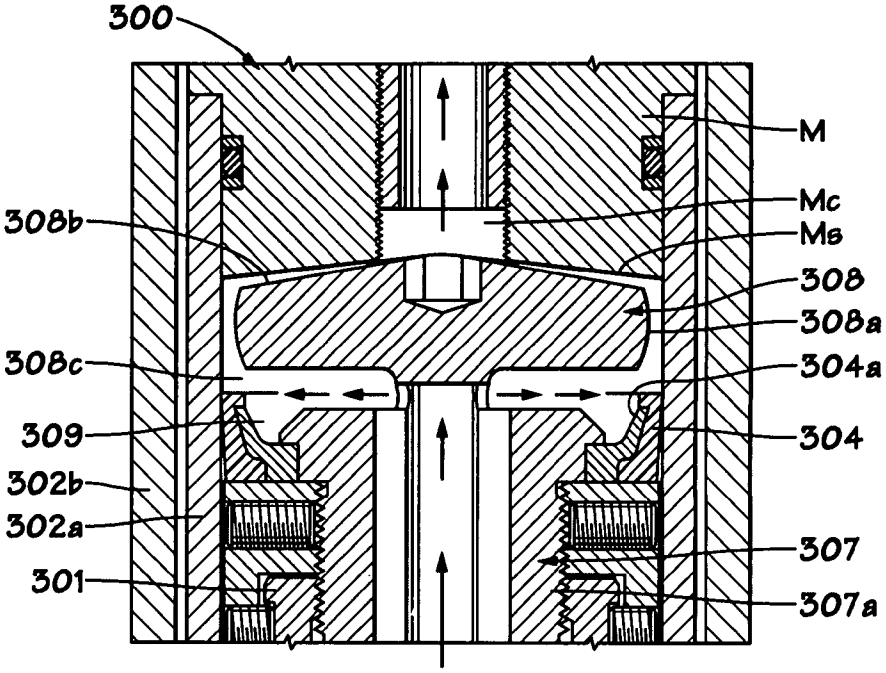
FIG. 3B is a cross-section view of a system with a diffuser according to the present invention.
Figure 3A:
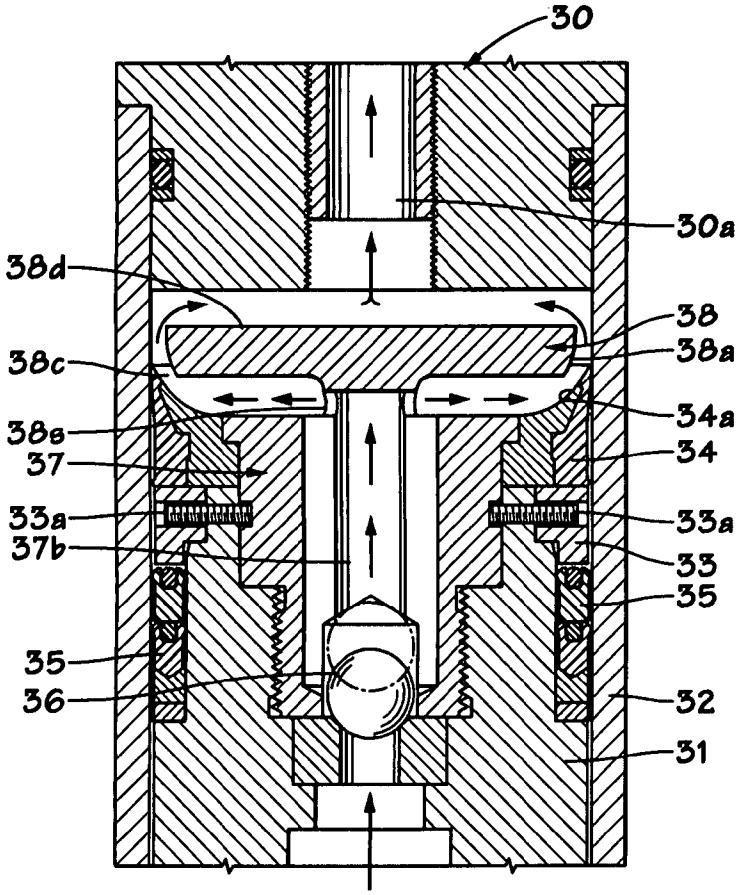
FIG. 3A is a cross-section view of a system with a diffuser according to the present invention.

A system 30 according to the present invention shown in FIG. 3A is used to protect a seal at a seal/sealing-surface interface between a pump piston's exterior and an inner surface of a member in which the piston moves. A piston 31 (shown partially) moves in a barrel 32 and pumps produced fluid (e.g., water with solids therein) up through the system 30. The piston 31 has a top seal structure 34 with a lip 34*a*. Piston seals 35 that seal the piston/barrel interface are retained in place by a seal retainer 33.

An optional check valve 36 is used in series with a travelling check valve (not shown; like any travelling check valve disclosed herein) which moves with the piston 31 for gas management if gas entrained in the fluid being pumped inhibits check valve operation. Using two such valves separates the fluid into two areas thereby reducing the force needed to operate the lower valve. A diffuser structure 37 is connected to the piston 31. Set screws 33*a* connect the seal retainer 33 to the piston 31 and also connect the diffuser structure 37 to the piston.

The diffuser structure 37 has a body 37*a* to which is connected a diffuser 38 which is generally a disc 38*d* with a stem 38*s* and an outer edge 38*a*. Fluid flows through the system 30 as indicated by the arrows in FIG. 3A-*through* the piston 31 to and through a channel 37*b* of the diffuser structure 37, out from the diffuser structure 37 below the diffuser 38, around the diffuser 38, and up to an upper flow channel 30*a* from which the fluid can flow out of the system (and, in one particular aspect, to a dam structure as in FIGS. 2A-2D).

The outer edge 38*a* of the diffuser 38 is spaced apart a desired distance from the lip 34*a* forming a high fluid velocity channel 38*c* adjacent the lip 34*a* which effects flushing of the area around the lip 34*a* inhibiting the trapping of solids, e.g., but not limited to, abrasive particles, between the seal structure 34 and the inner wall of the outer barrel 32. This high velocity channel is also, due to the high fluid velocity, an area of lower pressure (pressure in the channel lower than pressure of the fluid pumped up to the diffuser structure). This decrease in fluid pressure adjacent the seal 34 reduces wear on the seal 34, enhancing seal life.

A system 300 according to the present invention shown in FIG. 3B is used to protect a seal at a seal/sealing-surface interface between a pump piston's exterior and an inner surface of a member in which the piston moves. A piston 301 (shown partially) moves in an inner barrel 302*a* and pumps produced fluid (e.g., water with solids therein) up through the system 300. The piston 301 has a top seal structure 304 with a lip 304*a*. The inner barrel 302*a* is within an outer barrel 302*b*.

A diffuser structure 307 in a chamber 309 within the inner barrel 302*a* is connected to the piston 301, has a body 307*a* to which is connected a diffuser 308 which has an outer wall 308*a*. Fluid flows through the system 300 as in the system 30 above (and, in one particular aspect, to a dam structure as in FIGS. 2A-2D) and out from the diffuser 308.

The outer wall 308*a* of the diffuser 308 is spaced apart a desired distance from the lip 304*a* forming a high fluid velocity channel 308*c* adjacent the lip 304*a* which effects flushing of the area around the lip 304*a* inhibiting the trapping of solids, e.g., but not limited to, abrasive particles, between the seal structure 304 and the inner wall of the outer barrel 302. This high velocity channel is also, due to the high fluid velocity, an area of lower pressure (pressure in the channel lower than pressure of the fluid pumped up to the diffuser structure). This decrease in fluid pressure adjacent the seal 304 reduces wear on the seal 304, enhancing seal life.

The diffuser 308 has a top surface 308*b* which slopes down from a top of the diffuser 308 to the top of the outer wall 308*a*. A mandrel M above the diffuser 308 has a lower surface Ms that is sloped to correspond to the shape of the top surface 308*b*. These sloping surfaces facilitate the flushing of solids from the chamber and to a solids dam area. Sufficient space is provided between the top surface 308*b* and the lower surface Ms of the mandrel M so that fluid flows from the chamber 309 to a mandrel flow channel Mc.

FIG. 4A shows a system 40 according to the present invention which includes a downhole pump apparatus 41 (shown schematically) for pumping fluid from a well. A piston apparatus 42 above the pump apparatus 41 pumps produced fluid to a chamber 44 from which it then flows in an outlet line 44*a* out from the well. The fluid is pumped by the pump apparatus 41 up within a piston rod 45 into the chamber 44. The piston apparatus 42 has a piston 46 (sometimes called a "power piston") that moves within an inner barrel 47*a* and on the piston rod 45. The inner barrel 47*a* is disposed within an outer barrel 47*b*. Power fluid (e.g., hydraulic fluid) for the pump apparatus 41 is supplied through a line 48 between the inner and outer barrels down to a chamber below the piston 46 to power the piston 46 upwards.

The piston 46 has a body 46*a* and one seal or, as shown, multiple seals 49*s* for sealing the piston/inner-barrel interface and multiple bearings 49*b*. Any seal(s) and/or bearing(s) according to the present invention may be used. Each seal 49*s* may have a lubrication ring.

A piston apparatus 400 shown in FIG. 4B has a piston 410 in an inner barrel 402 which is disposed in an outer barrel 404. A pump apparatus 406 pumps fluid through a piston rod 408 to a chamber 409 from which the piston 410 pumps the fluid out from the chamber 409. The piston 410 has a body 412 with a channel 414 in which the piston rod 408 is disposed. An upper seal 416 seals the piston/inner-barrel interface at the top of the piston 410. A check valve 418 within the body 412 is like the check valve in FIG. 3A.

The piston 410 (sometimes called a "power piston") has a seal assembly 420 with multiple seals 422 that seal the piston/inner-barrel interface along the length of the piston 410. Although a cup-shaped seal is shown, described in more detail below, any suitable seal or seals may be used for the seals 422. Optionally spacers 424 are used between seals 422 and, also optionally, backup rings 426 are used to backup each seal 422. Lower seals 428 also seal the piston/inner-barrel interface. A bearing 427 is below the seals 428. Seals 429 seal the piston/piston-rod interface.

FIG. 4C shows in an enlarged view a portion of the seal assembly 420, FIG. 4B. Each seal 422 has a projection 422*a* which is received in a corresponding recess 426*a* of an adjacent backup ring 426 below the seal 422. Optionally, each ring 426 has an anti-extrusion ring 426*b* which inhibits extrusion of the seals and/or spacers into a gap between the surface of the inner barrel and the spacers 424. Optionally, such an anti-extrusion ring is located in a groove or recess in the piston. As an upper seal wears, a lower seal seals the piston/inner-barrel interface. Each spacer 424 has a side projection 424*a* which is received in a corresponding recess 410*a* in the piston 410. The spacers 424 prevent adjacent seals from loading each other and they also maintain correct seal location.

As is generally true for the pump systems according to the present invention and for various parts thereof, the seals 422 when viewed from top or bottom (see FIG. 4D) have a generally circular shape or cross-section, as do, for example, the piston rod, the inner barrel, the outer barrel, the piston body, etc.

The backup rings 426 support the seals 422 prolonging useful seal life; act as a bearing for the piston 410 (e.g. when rings are made as desired from any known suitable bearing material, e.g., but not limited to, polytetrafluoroethylene); inhibit extrusion of the seals 422 as the seals 422 wear and thereby inhibit undesirable wobbling of the piston 410; and serve, when made of appropriate material, as the provider of lubricant for facilitating movement of the piston 410 on the interior surface of the inner barrel 402.

Using multiple seals and/or bearings along the length of a piston reduces or prevents wobbling of the piston. Optionally a space is provided between one of the spacers and a seal below the spacer, e.g. space SP, FIG. 4C, which provides for some minimal axial movement of a seal which allows some fluid into a cup CP of a seal to enhance sealing contact of the seal with a barrel. To inhibit or prevent pressure trapping by the seals, the bearings 426 may have a channel which allows the bearings to "breathe" and not act like a seal.

Figure 4E:
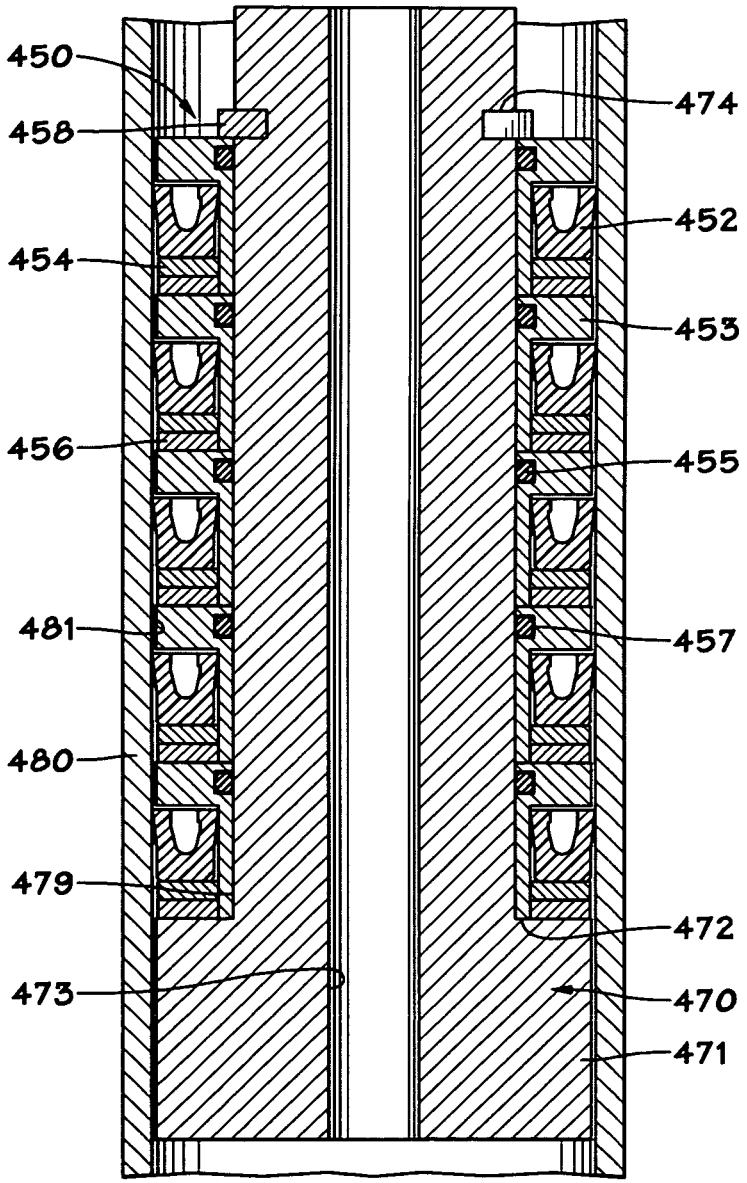
FIG. 4E is a cross-section of a seal system according to the present invention.

FIG. 4E shows a seal system 450 according to the present invention for sealing the interface between an exterior surface 479 of a piston body 471 of a piston 470 and an interior surface 481 of a barrel 480 in which the piston 470 moves. The piston 470 has a central flow bore 473 and can be any piston of any pump or system according to the present invention.

The seal system 450 rests on a shoulder 472 of the piston body and is held in place by a retainer ring 458 in a recess 474 of the piston body. The seal system 450 has a plurality of seals 452 (e.g., like the seal 422, FIG. 4C) each of which is on anti-extrusion backup rings 454 and 456.

Other than the lowermost seal 452, seal carriers 453 support the seals 452 and space them apart. Each seal carrier 453 has a recess 457 which holds an O ring 455 that seals the seal-carrier/surface-479 interface.

In one aspect, the various parts are made of the following materials: seals 452, niotrile rubber; antiextrusion rings 454 and antiextrusion rings 456, engineering grade plastics, PEEK, PPE, PPS; O rings 455, nitrile rubber; seal carriers 453, bearing material, brass; retainer ring 458, steel.

Figure 5:
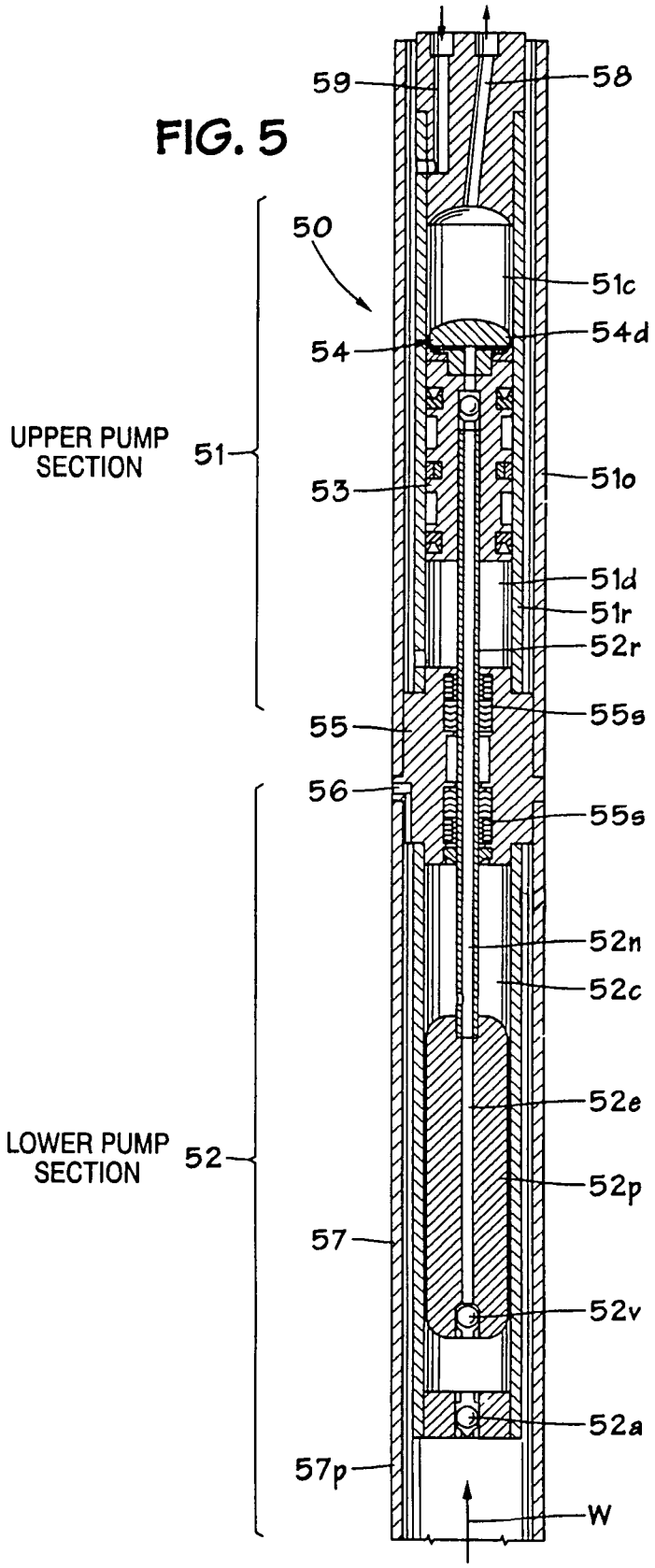
FIG. 5 is a side cross-section schematic view of a system according to the present invention.

FIG. 5 illustrates a system 50 according to the present invention which has an upper pump section 51 and a lower pump section 52. The lower pump section may employ any suitable downhole liquid pump system for pumping fluid to the upper pump section 51. For example, in one particular embodiment, the lower pump section may use a commercially available Harbison Fischer water pump. The lower pump section 52 is connected to the upper pump section 51 with a central mandrel 55.

Fluid, e.g. produced water with solids, moves from the lower pump section 52 through a piston rod 52*r* (fixed/secured to a piston 53 and to a water plunger 52*p*) to an upper chamber 51*c* by action of the piston 53. As hydraulic power fluid pumped down in a power fluid conduit 59 is applied to the bottom of the piston 53, the piston 53 (sometimes called a power piston) rises (since the pressure of the hydraulic fluid exceeds that of the produced fluid in a lower pump section chamber 52*c* which is communicated to the piston 53 via the piston rod 52*r*), the piston 53 forces produced fluid out of the upper chamber 51*c* into the produced fluid conduit 58. As the piston 53 rises, the plunger 52*p* also rises within the chamber 52*c* and a check valve 52*v* (sometimes called a traveling valve) closes, causing produced fluid in the chamber 51*c* to be expelled therefrom into the conduit 58.

A low pressure region below the water plunger 52*p* is created as the water plunger 52*p* lifts, allowing fluid from the wellbore W to open a check valve 52*a* (sometimes called a standing valve) and to enter the chamber 52*c* below the water plunger 52*p*. The water plunger 52*p* has a central channel 52*e* through which fluid flows to an interior channel 52*n* of the piston rod 52*r*.

The piston 53 moves within an inner barrel 51*r* (generally cylindrical) which is mounted within an outer barrel 51*o* (generally cylindrical). The outer barrel 51*o* is connected to the central mandrel 55. The piston 53 may be any piston disclosed herein according to the present invention, including, but not limited to, the piston 46, FIG. 4A or the piston 410, FIG. 4B. The piston 53 may have any seal assembly, seal(s), spacer(s), and/or seal backup ring(s) disclosed herein. Seals 55*s* seal the rod/central-mandrel interface.

A chamber 51*d* below the piston 53 is filled with hydraulic fluid as the piston 53 rises and a surface valve (not shown) is opened allowing the hydraulic fluid to return to the surface equipment (e.g. to a reservoir). On top of the piston 53 is produced fluid and a pressure differential on the piston (due to the area differential between the area of the piston and the cross-sectional area of the piston rod; also there can be a density differential if fluids of different density are being pumped, e.g., water with petroleum-based hydraulic fluid) moves the piston 53 down.

As the piston 53 moves down, the chamber 51*c* fills with produced fluid and the water plunger 52*p* displaces fluid in the chamber 52*c* forcing it into the chamber 51*c*. Due to the reduction in volume of the upper chamber 51*c* to the chamber 52*c*, a volume of produced fluid equal to the volume of the piston rod 52*r* (cross-sectional area times stroke length) is forced into and from the conduit 58.

A diffuser structure 54 with a diffuser 54*d* is mounted to the top of the piston 53. The diffuser 54*d* may be any diffuser disclosed herein according to the present invention, including, but not limited to, those in FIGS. 3A and 3B.

The lower pump section 52 has, optionally, an outer tubular 57 (generally cylindrical), sometimes called a dip tube, with a lowermost part 57*p* which acts as a gas trap extension if part of the tubular 57 traps gas from the well in which the system 50 is used. According to the present invention, a check valve 56 is provided near the top of the tubular 57 which selectively allows the interior of the tubular 57 to communicate with the space exterior to the tubular 57.

This check valve allows gas, at a known pressure, which builds up within the tubular 57 to vent from the tubular's interior. In one particular embodiment, this check valve opens when the gas pressure is, e.g., higher than the pressure of two feet of water. In one particular aspect, the tubular 57 extends about forty feet below the check valve 52*a*. In one aspect the valve is about twelve feet above the pump inlet, allowing gas to be higher than the pump inlet so that the gas can vent from this higher position.

It is within the scope of the present invention when the apparatus according to the present invention employs an inner barrel (e.g., but not limited to the inner barrel 51*r*, FIG. 5) and outer barrel (e.g., but not limited to, the outer barrel 51*o*, FIG. 5; or the barrels shown in FIG. 10), to preload the inner barrel in compression against the outer barrel when assembling the apparatus so that: in operation, when the outer barrel expands or grows, the inner barrel is in compression to the extent of the growth of the outer barrel (see, e.g., the embodiment of FIG. 10); when there is no pressure on the outer barrel, the inner barrel applies an axial load on the outer barrel due to preloading of the outer barrel; when pressure is applied on the outer barrel, at full system pressure the axial force on the outer barrel is not changed, it is static, and fatigue of the outer barrel does not affect adversely the inner barrel or the outer barrel's threads.

In one embodiment a surface on the central mandrel abuts a bottom of the inner barrel to allow preloading of the inner barrel; thus, the central mandrel holds the inner barrel in a compressed pre-load condition with the top of the inner barrel pushing against part of a top sub or top member (e.g, but not limited to, against a part of a dam sub such as the structure 208 of FIG. 2D) and with the inner barrel stationary with respect to the outer barrel during operation. Inhibiting or preventing dynamic motion between the two barrels prolongs seal life and enhances seal integrity.

Figure 6:
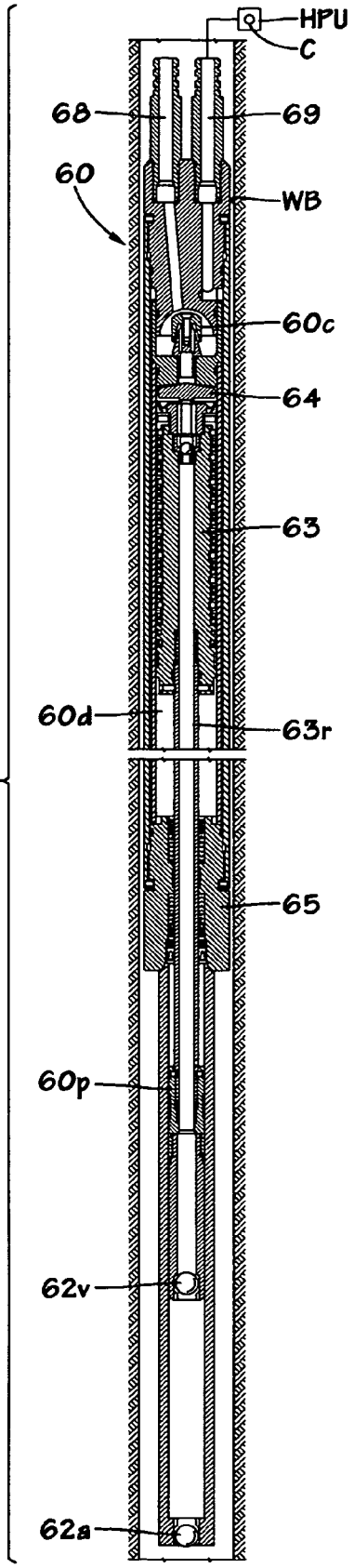
FIG. 6 is a side cross-section schematic view of a system according to the present invention.

FIG. 6 shows a system 60 system according to the present invention for removing liquid from a wellbore WB in the earth. The system 60 employs a liquid removal system like that of FIG. 5 and fluids follow the same general flow paths in the system 60 as they do with the system of FIG. 5. An hydraulic power unit HPU at the surface provides hydraulic power fluid to the system 60 and includes a computerized control system C which controls the unit HPU (and any embodiment of the present invention may be used in a wellbore like the wellbore WB and/or with a control system like the system C and/or with an hydraulic power unit like the unit HPU).

Hydraulic power fluid is provided through a line 69 to a lower hydraulic chamber 60*d* (like the chamber 51*d*, FIG. 5) of a body 62 to move a piston 63, a power piston, (like the piston 53). A diffuser 64 is like the diffuser 54. The system 60 also includes a contraflow apparatus 60*c* which may be any contraflow apparatus according to the present invention and is, in one aspect, like the apparatus shown in FIG. 2D. Produced fluid flows in a line 68 as it does in the conduit 58, FIG. 5. A mandrel 65 is like the mandrel 55; a check valve 62*v* (traveling valve) is like the check valve 52*v*; a check valve 62*a* (standing valve) is like the check valve 52*a*; a piston rod 63*r* is like the piston rod 52*r*; and a water plunger 60*p*, sometimes called a water piston, is like the water plunger 52*p*. As with the system 50, the system 60 is a single action system and the hydraulic power fluid lifts the piston 63 (and the water plunger 60*p*) to move fluid from the system; and the weight of the produced fluid above the piston 63 moves the piston 63 back down in the lower hydraulic chamber for another stroke.

Figure 7:
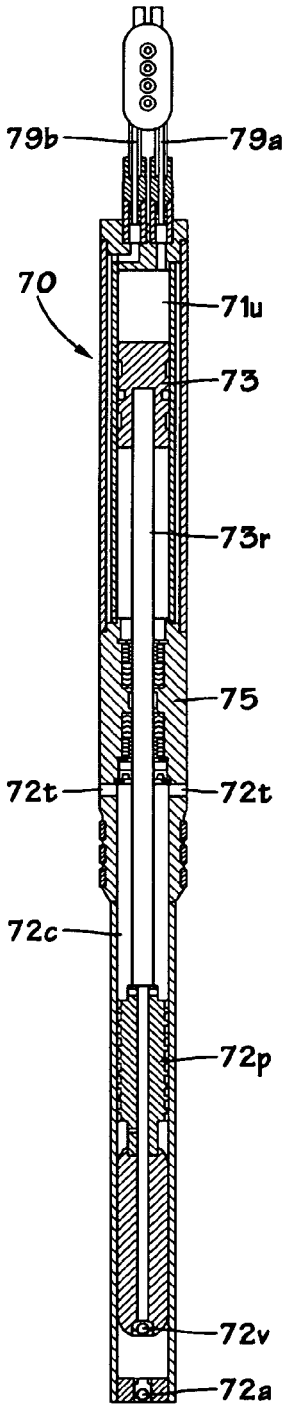
FIG. 7 is a side cross-section schematic view of a system according to the present invention.

FIG. 7 shows a system 70 according to the present invention which is a dual action system—hydraulic power fluid raises the system's piston 73 and pressure of hydraulic fluid returns a water plunger for another stroke. The piston 73, sometimes called a power piston, may be like any piston disclosed herein according to the present invention. Hydraulic power fluid flows selectively in a line 79*a* to an upper hydraulic chamber 71*u* (to move the piston 73 down) and in a line 79*b* to move the piston 73 up.

Water pumped by a water plunger 72*p*; like the water plungers of FIGS. 5 and 6) is pumped from outlets 72*t* of a chamber 72*c*. On the downstroke of the piston 73 and on the upstroke of the piston 73, water is pumped into the chamber 72*c* from a well in which the system 70 is used. A mandrel 75 is like the mandrels 55, 65; a check valve 72*v* (traveling valve) is like the check valves 52*v*, 62*v*; a check valve 72*a* (standing valve) is like the check valves 52*a*, 62*a*; a piston rod 73*r* is like the piston rods 52*r*, 62*r*; and a water plunger 72*p* is like the water plunger 52*p*, 60*p*.

In certain aspects, well liquid removal pump systems according to the present invention are run through tubing or through casing. FIG. 8A shows schematically an up stroke of a system 80 according to the present invention run through casing. The system 80 has a body 82, a power piston 83, a pump piston 84, a traveling valve 85 that travels with the pump piston, and a bull nose 86 with a standing valve 87. Two coil tubing strings 88 and 89 are connected to the system 80 using a suitable connection structure, e.g., but not limited to a commercially available FLATPAK (trademark) apparatus. The system 80 can hang from tubing or can seat in a seating structure 80*n* (shown schematically; e.g., see FIG. 13).

As shown in FIG. 8A, as hydraulic power fluid is supplied by a power unit (not shown) through the string 89 below the power piston 83, the power piston 83 is raised, pushing well fluid, e.g. water with solids therein, out through the string 88. Simultaneously, the pump piston 84, which moves with the power piston 83 via its connection thereto with a hollow piston rod 83*r*, pumps liquid into the system with the traveling valve 85 closed and the standing valve 87 open.

During the down stroke shown in FIG. 8B, the traveling valve 85 is open and the standing valve 87 is closed; the weight of the water above the power piston 83 moves the power piston 83 down and moves the pump piston 84 down; well liquid flows through the traveling valve 85 and within the pump piston 84; while hydraulic power fluid beneath the power piston 83 is moved from beneath the power piston 83 back to a surface container.

FIG. 8C presents data for certain particular embodiments of a through-casing system according to the present invention. The pump outside diameter is the outer diameter, e.g., of the body 82, FIGS. 8A, 8B. The water piston is, e.g., a pump piston, e.g. the pump piston 84, FIGS. 8A and 8B.

Figure 8D:
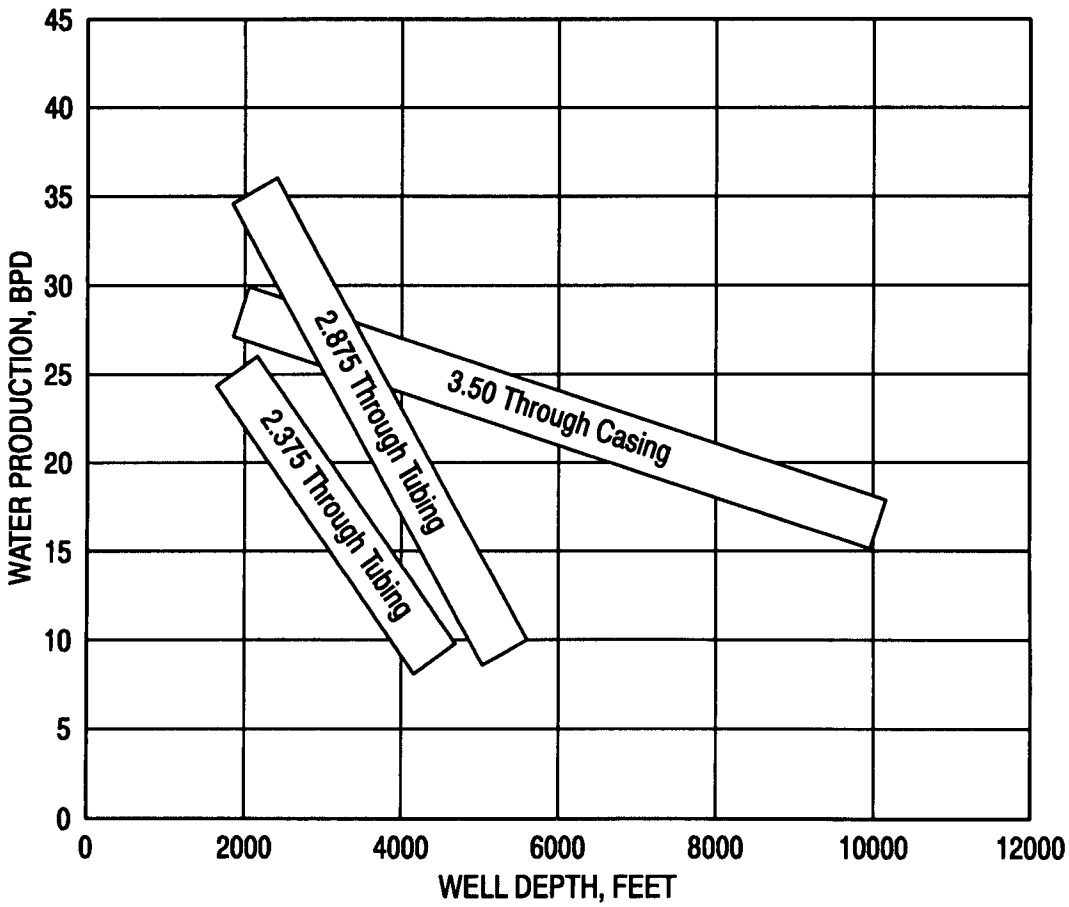
FIG. 8D presents in graphic form data for certain systems according to the present invention.

FIG. 8D is a graph presenting fluid output for single acting systems according to the present invention. The x-axis, "Well Depth-Feet," is the depth in a well at which the system is used; and the "Water Production-BPD," the y-axis, is in units of BPD, barrels per day. Data is presented for a through casing system used in casing of 3.5 inch diameter; for a through tubing system used with tubing of 2⅞ inch diameter; and for a through tubing system used with tubing of 2⅜ inch diameter.

In certain aspects, well liquid removal pump systems according to the present invention are run through tubing. FIG. 9A shows schematically an up stroke of a system 90 according to the present invention run through tubing (production tubing) PT. The system 90 has a body 92, a power piston 93, a pump piston 94, a traveling valve 95 that travels with the pump piston 94, and a standing valve 97. A coil tubing string 98 is connected to the system 90 using a suitable connection. The system 90 seats in a pump seating nipple 99 at the bottom of the tubing.

As shown in FIG. 8A, as hydraulic power fluid is supplied by a power unit (not shown) through the string 98 below the power piston 93, the power piston 93 is raised, pushing well fluid, e.g. water with solids therein, out through a body opening 92*a* into an annulus 90*a* between the exterior of the body 92 and the interior of the tubing. Simultaneously, the pump piston 94, which moves with the power piston 93 via its connection thereto with a piston rod 93*r*, pumps liquid into the annulus 90*a* and pumps liquid from the well into the body 92 below the pump piston 94 with the traveling valve 95 closed and the standing valve 97 open.

During the down stroke shown in FIG. 9B, the traveling valve 95 is open and the standing valve 97 is closed; the weight of the water above the power piston 93 moves the power piston 93 down and moves the pump piston 94 down; well liquid flows through the traveling valve 95 and above the pump piston 94 and at this time into the annulus 90*a*; while hydraulic power fluid beneath the power piston 93 is evacuated from beneath the power piston 93 through the string 98 back to a surface container.

FIG. 9C presents data for certain particular embodiments of a through-tubing system according to the present invention. The pump outside diameter is the outer diameter, e.g., of the body 92, FIGS. 8A, 8B. The water piston is, e.g., a pump piston, e.g. the pump piston 94, FIGS. 8A and 8B.

Figure 10:
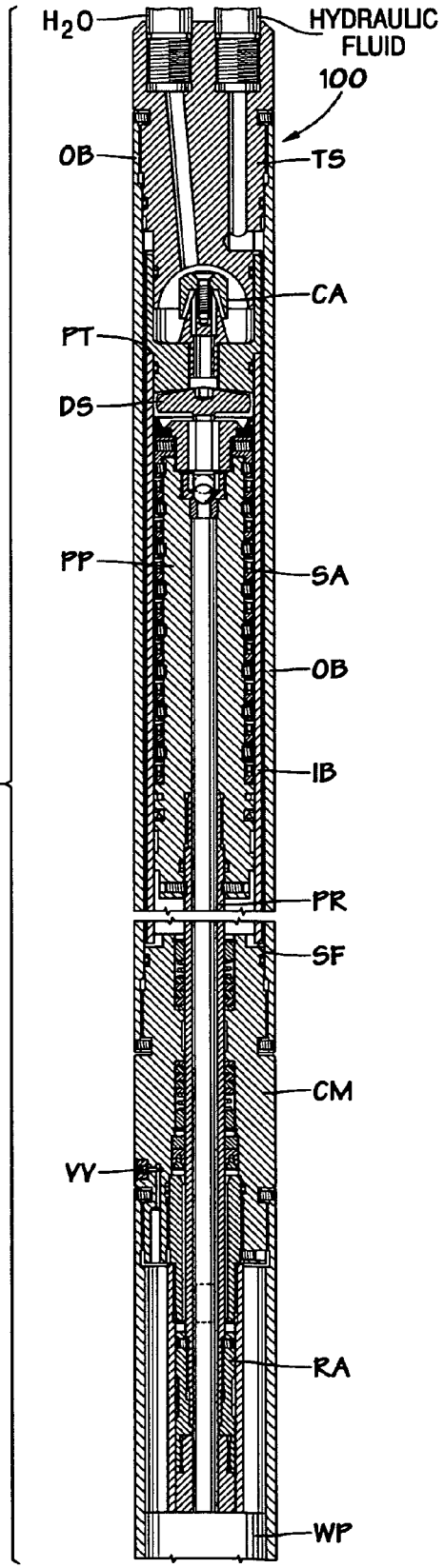
FIG. 10 is cross-section view of a system according to the present invention.

FIG. 10 shows a system 100 according to the present invention which has a contraflow apparatus CA (e.g., like that of FIG. 2D); a diffuser structure DS (like that of FIG. 3B); a power piston PP (like that of FIG. 4B; a central mandrel CM (like those of FIGS. 5-7; and a water pump WP (shown schematically; like those of FIGS. 4A, 4B, 5, 8A, 9A, and 11). Water ($H_2O$) flows in one line. Power fluid (hydraulic fluid) flows in the other line. FIGS. 10A and 10B present enlargements of certain parts of the system 100 as shown in FIG. 10. A dip tube vent valve VV acts like the valve 56, FIG. 5.

The system 100 has an outer barrel OB (cylindrical, hollow tubular) which encompasses an inner barrel IB (cylindrical, hollow tubular). In one aspect, during assembly of the system 100, the inner barrel IB is preloaded in compression against the outer barrel OB. A surface SF on the central mandrel CM abuts a bottom of the inner barrel IB and a top of the outer barrel OB is threadedly connected to a top sub TS. The central mandrel CM holds the inner barrel IB in a compressed preload condition with the top of the inner barrel pushing against part PT of the top sub TS and thus the inner barrel IB is stationary with respect to the outer barrel OB during operation.

A hollow piston rod PR is connected to a rod adapter RA that connects the power piston PP to a piston, not shown, of the water pump apparatus WP. Seal assemblies SA on the power piston PP are like those of FIG. 4B and FIG. 4C. 1E is a cross-section view of a system according to the present invention.

Systems according to the present invention can employ multiple power pistons, one above the other, each with its own chamber and, optionally, each with its own diffuser according to the present invention.

FIG. 11 shows schematically a system 110 according to the present invention which has an above-ground hydraulic supply system 112 which provides hydraulic power fluid to a pump system 111 according to the present invention of a well liquid removal system PA. The pump system may be any system according to the present invention which has a single-acting pump according to the present invention and/or with any valves and/or with any check valves disclosed herein.

The above-ground hydraulic power supply system 112 has a pump 114 which selectively pumps hydraulic power fluid 118 between a reservoir 113 and a chamber 121 below a power piston 110*p* of the pump system 111 through lines 111*a*, 111*b*, 111*c*, 111*d*, and 119. A control system 115 controls the pump 114 and a valve system 116.

The liquid removal system PA has a water pump system 130 (which may be any liquid pump system disclosed herein, including, but not limited to, those of FIGS. 5,6, 7, 8A, and 9A). The pump system 130 has a liquid plunger 132, a traveling valve 133 and a standing valve 134. A hollow piston rod 128 connects the piston 110*p* and the water plunger 132 through which liquid from the chamber 138 can flow, on a piston downstroke, to the chamber 110*a*. Water from the well in which the system is used flows up through the piston rod 128 to the chamber 110*a*. A chamber 136 above the water plunger 132 is in fluid communication with the chamber 110*a*. Water flows into the chamber 138 from the well on the downstroke of the piston 110*p*.

As pressure is supplied by the pump 114, through the valve system 116 as controlled by the control system 115, through the line 119 to the bottom side of the piston 110*p*, the piston 110*p* is forced upwards. As the piston 110*p* rises due to the differential between the applied hydraulic fluid pressure and the pressure of produced liquid above the piston 110*p*, well bore fluid is forced out of the system PA in the line 121 (e.g., to an exit tubing or into an annulus within production tubing or casing).

As the piston 110*p* rises, it forces the water pump plunger 132 upwards simultaneously. As the water pump plunger 132 lifts, the traveling valve 133 therein closes, causing liquid above the water plunger in a chamber 136 to be forced into the line 121. In a space 138 below the water plunger 132, a low pressure region is created as the water plunger 132 lifts, allowing fluid from the wellbore 139 to open the standing valve 134 and wellbore fluid flows into the space below the water plunger 132. As a result of this, the space 110*b* below the piston 110*p* fills with hydraulic fluid from the line 119 and the control system 115 opens the valve system 116 allowing the hydraulic fluid to return to the reservoir 113.

There is a specific gravity differential of the liquid in a space 110*a* on top of the piston 110*p* and the hydraulic fluid beneath the piston 110*p*. This and the area differential (described above) produce a pressure differential on the piston causing a net downward force on the piston 110*p*. As the piston 110*p* moves down, the chamber 110*a* fills with liquid from the wellbore and the water plunger 132 displaces liquid in the chamber 138 forcing this liquid into the chamber 136. Due to the reduction of volume of the upper chamber 136, a volume of liquid equal to the volume of the piston rod 128 is forced into the line 131 and then into the chamber 110*a*.

FIG. 12A shows a seal assembly 120 useful as a seal for a piston such as, but not limited to, the power pistons of various embodiments of the present invention. The seal assembly 120 includes a base 122 which supports and backs up a cup member 124. The base 122 is generally cylindrical with two open ends and a circular bottom recess 123 in which is disposed an optional anti-extrusion ring 126.

The cup member 124 is wider at its top than at its bottom and may, optionally, include an inner support 128. This support 128 may be made of any suitable material (e.g. but not limited to plastic, metal, and composite) and, in one particular aspect, is made of ultra high molecular weight polyethyelene. In one particular aspect as shown, the support 128 is made of spring material which is shaped and configured to urge the two sides of the cup member apart, thereby urging the two sides into surface sealing contact to enhance the sealing effects of the seal assembly 120.

FIG. 13 illustrates schematically a system 130 according to the present invention used in tubing 132 with a pump system 136. Two fluid flow lines A and B are used with a weld connector W. The system 130 seats on a seating nipple 134 which has seating cups 135. Water inlets 133 are located below a gas trap extension 131 of the tubing. The pump system 136 has a lower check valve 139; and the tubing 132 has a purge check valve 138 at its lower end. In a certain particular aspect, the tubing 132 is 2⅜ inch or 2⅞ inch tubing; the weld connector is a weld connector for ⅝ inch tubing; and the pump system 136 has SAND PRO (Trademark) plunger system soft seals and a clearance plunger with pressure balanced ports.

It is within the scope of the present invention for the system 130 to be any system according to the present invention disclosed herein. It is within the scope of the present invention for the system 136 to be any pumping system disclosed herein.

It is within the scope of the present invention to provide systems and methods in which power fluid for moving a piston is applied on the top of the piston, not the bottom; and for produced liquid, e.g., but not limited to water, to be on the bottom of the power piston. In such a system with a fluid plunger or "water piston", liquid on the top of the plunger is open to bottom hole pressure and can circulate in and out of a chamber of the pump system at bottom hole pressure. For such a system, referred to as a "power down design" system or a "PDD system," the power stroke of the power piston is downward, either directly or via a fluid isolation system. In such a system, a raise stroke for raising fluid to pump it from a wellbore can use a "boost" pressure from the surface, e.g. a backpressure provided by a surface system.

With such a system in which power fluid for moving a piston is applied on the top of the piston, the pump can be deployed in production tubing with coiled tubing on the outside. The pump can be removed or "pumped out of the hole" and does not require a coiled tubing rig to pull it from a wellbore. A PDD system according to the present invention is also operable effectively without a coil-tubing encasing apparatus (e.g., a FlatPak (trademark) apparatus).

A PDD system according to the present invention can operate at a relatively lower pressure than certain "power up" systems; e.g., in one aspect, a pressure about 12% lower. In certain PDD systems, the power fluid acts on a larger area, i.e., such a PDD system makes possible the use of a larger water plunger with a greater cross-sectional area which displaces more water per inch of stroke thereby increasing the pump's liquid production. In one particular aspect, the power fluid acts on the top of a power piston whose top area is about 16% greater than its bottom area. A return stroke power acts on the piston's bottom area, the smaller area, which makes it possible to use a relatively larger water plunger.

With a power down design, operation at lower pressure with water as a power fluid takes advantage of the relatively low compressibility of water as compared to the compressibility of other power fluids (such as hydraulic power fluid). The "spring effect" of hydraulic power fluid in a wellbore is greater than that of a power fluid such as water, and, therefore, the use of a power fluid such as water results in lower required system operating pressure—for pumping a similar volume of liquid, a PDD system requires relatively lower operating pressure.

Figure 14:
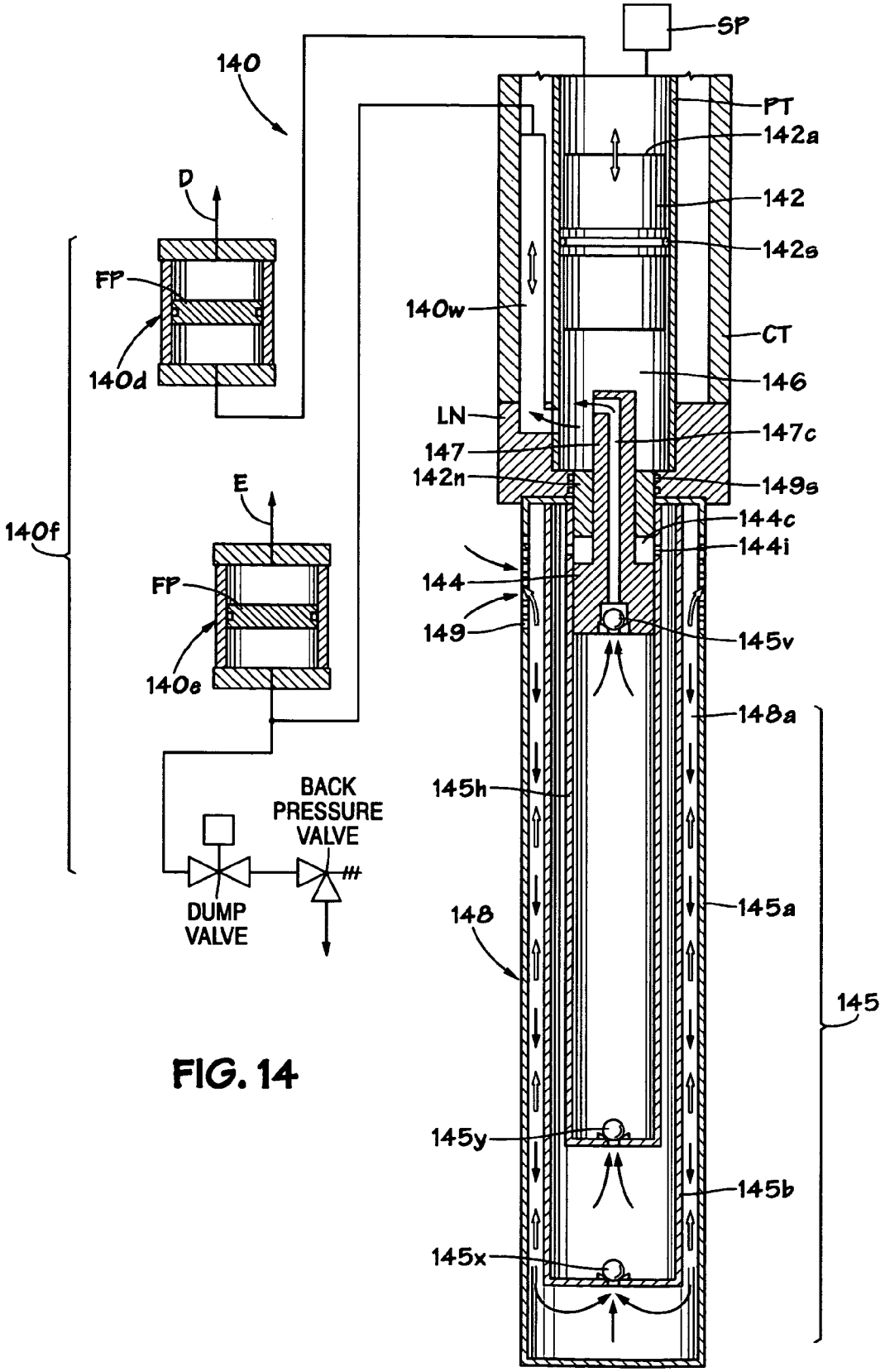
FIG. 14 is side cross-section schematic view of a system according to the present invention.

FIG. 14 shows a power-down-design system 140 according to the present invention in which power fluid (e.g. water) fluid for moving a piston 142 is applied on a top 142*a* of the piston 142. Liquid from a wellbore flows into the liquid pumping system via inlets 149 (e.g. liquid that is or that includes water). In one aspect, the system 140 is disposed in coil tubing CT that is connected (e.g., strapped) to production tubing PT and power fluid is supplied through the production tubing to the top of the piston.

A water plunger 144 of a liquid pump 145 is movable to pump liquid from a wellbore through inlets 149, to a chamber 146, from which the power piston 142 pumps it ("Produced Water") to the surface through a conduit 140*w*. Liquid flows into and out from a chamber 144*c* on top of the water plunger 144 via openings 144*i*.

When the power fluid moves the power piston 142 down, the power piston 142 moves a piston rod 147 down, moving the water plunger 147 down displacing liquid within the liquid pump 145. As the water plunger 144 moves down within a housing 145*h*, a valve 145*v* in the water plunger 144 opens and liquid within the housing 145*h* is forced up into a channel 147*c* of the rod 147. This liquid moves into the chamber 146 and then to and through the conduit 140*w*.

In a gas anchor structure 148, liquid from a wellbore entering the system travels in through inlets 149 and then down an annulus 148*a* between the housing 145*a* and a pump barrel 145*b*. The liquid is pumped through a standing valve 145*x* into the space within the pump barrel 145*b* and then through a valve 145*y* into the housing 145*h*.

Gas in the liquid traveling in the annulus 148*a* separates from the liquid and, due to gravity, moves back up to the inlets 149 and through them exits the structure 148. In certain aspects, the velocity of the liquid moving through the annulus 148*a* is sufficiently low that the gas has time to separate from the liquid (in certain aspects, substantially all of the gas). In one particular aspect, the liquid velocity is about six inches per second and the liquid has a total residence time in the annulus of about thirty seconds. In one aspect, the structure 148 holds a volume equal to between four and five pump volumes.

A seal (or seals) 142*s* seal the power-piston/production-tubing interface. Seals 149*s* seal an interface between an interior surface of a landing nipple LN and a lower part of the power section_142*n* (which contains, e.g., rod seals, bearings; sometimes referred to as a "center sub" or "cylinder head"). In one aspect, these are low efficiency seals. With sufficient force of the power fluid pumped down by a surface pumping system SP, (pumped into the conduit 140*w*) the seals hold the pressure of the pumped fluid and the power piston can be pumped to the surface.

Optionally, a fluid isolation system (with an apparatus 140*d* as described below) makes it possible to use a different fluid in the production tubing PT instead of hydraulic fluid and provides the isolation of the power fluid from the hydraulic fluid. Thus, according to the present invention, it is possible to have a conventional hydraulic fluid system, while using pressure for power. In one aspect, pressure on the top of a power piston can be maintained (as the power piston moves down, produced liquid is forced up the conduit 140*w*).

One embodiment of a system 140*f* has floating piston apparatuses 140*d* and 140*e*. From both or either apparatus 140*d*, 140*e*, either hydraulic fluid can flow (from beneath a floating piston FP) or liquid can flow (from on top of the floating pistons). The floating piston apparatus 140*e* can provide produced water via the conduit 140*w* to return the power piston to an up position for a subsequent power stroke.

An arrow D on the top of the apparatus 140*d* indicates a flow conduit in communication with a rig pressure supply system (e.g., an hydraulic fluid supply system on a skid or a system SP). An arrow E n the top of the apparatus 140*e* indicates a flow conduit in communication with a rig pressure supply system (e.g., an hydraulic fluid supply system on a skid or a system SP).

It is within the scope of the present invention to use multiple power sections according to the present invention with a power down design; in one aspect, systems as in FIG. 14.

In one particular aspect, it is anticipated that a system like the system 140 is used in wells at depths as indicated below, with the indicated fluid pressures in p.s.i. (the pressure of the static head), the indicated part dimensions (in inches), and stroke pressures (in psi):

| Depth | Fluid Pressure | Power Piston Diam. | Fluid Piston Diam. | Rod Diameter | Power Stroke Pressure | Return Stroke Pressure |
|---|---|---|---|---|---|---|
| 5000 | 2100 | 1.875 | 1.75 | 1.125 | 1073 | 1181 |
| 10000 | 4200 | 1.875 | 1.75 | 1.125 | 2147 | 2363 g |

As can be easily understood from the foregoing, the basic concepts of the present invention may be embodied in a variety of ways. It involves both structures, method steps, and techniques as well as devices to accomplish the appropriate ends. Techniques and method steps according to the present invention are disclosed as part of the results shown to be achieved by the various devices and structures and described and as steps which are inherent to utilization and are simply the natural result of utilizing the devices and structures as intended and described. In addition, while some devices and structures are disclosed, it should be understood that these not only accomplish certain methods but also can be varied in a number of ways. Importantly, as to all of the foregoing, all of these facets should be understood to be encompassed by this disclosure.

The discussion herein is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented or apparatus-oriented terminology, each element of the device or apparatus implicitly performs a function. Apparatus claims may not only be included for the device or apparatus described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting the claims for any subsequent patent application.

It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these.

Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action.

Similarly, each physical element disclosed should be understood to encompass a disclosure of the action which that physical element facilitates. Regarding this last aspect, as but one example, the disclosure of a "support" should be understood to encompass disclosure of the act of "supporting"—whether explicitly discussed or not—and, conversely, were there effectively disclosure of the act of "supporting", such a disclosure should be understood to encompass disclosure of a "support". Such changes and alternative terms are to be understood to be explicitly included in the description.

Any acts of law, statutes, regulations, or rules mentioned in this application for patent; or patents, publications, or other references mentioned in this application for patent are hereby incorporated fully and for all purposes by reference. In addition, as to each term used it should be understood that unless its utilization in this application is inconsistent with such interpretation, common dictionary definitions should be understood as incorporated for each term and all definitions, alternative terms, and synonyms are hereby incorporated by reference.

Thus, the applicants for this patent should be understood to have support to claim and make a statement of invention to at least: i) each of the pump systems and new parts thereof as herein disclosed and described, ii) the related methods disclosed and described, iii) similar, equivalent, and even implicit variations of each of these systems, parts, and methods, iv) those alternative designs which accomplish each of the functions shown as are disclosed and described, v) those alternative designs and methods which accomplish each of the functions shown as are implicit to accomplish that which is disclosed and described, vi) each aspect, feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, and xii) each potentially dependent claim or concept as a dependency on each and every one of the independent claims or concepts presented.

With regard to claims whether now or later presented for examination, it should be understood that for practical reasons and so as to avoid great expansion of the examination burden, the inventors may at anytime present only initial claims or perhaps only initial claims with only initial dependencies. Support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept.

In any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually waived or relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

Any claims set forth at any time during the pendency of the application for this patent or offspring of it are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

In conclusion, therefore, it is seen that the present invention and the embodiments disclosed herein and those covered by the appended claims are well adapted to carry out the objectives and obtain the ends set forth.

Certain changes can be made in the subject matter without departing from the spirit and the scope of this invention. It is realized that changes are possible within the scope of this invention and it is further intended that each element or step recited herein is to be understood as referring to the step literally and/or to all equivalent elements or steps. It is intended to cover the invention as broadly as legally possible in whatever form it may be utilized. The invention described herein is new and novel in accordance with 35 U.S.C. §102 and satisfies the conditions for patentability in §102. The invention described herein is not obvious in accordance with 35 U.S.C. §103 and satisfies the conditions for patentability in §103.

The inventor may rely on the Doctrine of Equivalents to determine and assess the scope of the invention. All patents and applications identified herein are incorporated fully herein for all purposes. The word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

What is claimed is:

1. A pump system for pumping fluid, the fluid containing solids the pump system comprising a pump section with a fluid pump having a movable pump plunger for pumping fluid, the fluid with solids therein, a discharge section with a discharge pump for receiving fluid pumped by the fluid pump, the discharge pump for pumping the fluid out from the pump system, the discharge pump having a pump barrel with an interior surface, the discharge pump having a pumping piston with a sealing system, the pumping piston movable in the pump barrel, the pumping piston having a top, and a diffuser for facilitating fluid flow past the sealing system of the pumping piston, the diffuser comprising a disc, the disc having a disc top, the disc top having a disc top surface, the disc top surface being convex to facilitate flushing of solids from the disc top of the disc.

2. The pump system of claim 1 further comprising the discharge pump having a discharge mandrel which receives fluid flowing past the diffuser, the discharge mandrel having a mandrel bottom surface adjacent the disc top surface of the disc top, the mandrel bottom surface being concave to facilitate flushing of solids from the disc top of the disc.

3. The pump system of claim 1 wherein the fluid includes water and wherein the fluid with solids therein is in a wellbore and the pumping system is a well deliquefication system.

4. The pump system of claim 1 wherein the discharge pump is one of single action or double action.

5. The pump system of claim 1 further comprising the diffuser comprising a body with a body inlet for receiving fluid pumped by the pumping system, the body connectible to the pumping piston, the body having a body outlet from which pumped fluid exits the body, a disc with a stem, the stem connected to the body, the disc diffusing fluid flow past the sealing system.

6. The pump system of claim 5, the diffuser further comprising the disc having a bottom surface and a top surface spaced-apart from the bottom surface, the disc positioned so that fluid exiting from the body outlet exits the body outlet below the disc and the fluid exiting the body outlet is movable below the bottom surface of the disc and then past the sealing system.

7. The pump system of claim 5, the diffuser further comprising the body outlet positioned so that fluid exiting from the body outlet is movable past the sealing system, the disc having an outer edge spaced apart from the sealing system, a high velocity channel defined by defining parts comprising the outer edge of the disc and a portion of the interior surface of the pump barrel, the sealing system having at least one piston seal, and flow of fluid in the high velocity channel inhibiting damage of the at least one piston seal of the sealing system by the fluid.

8. The pump system of claim 6, the diffuser further comprising the at least one piston seal comprising a seal with a top lip, the top lip defining a part of the high velocity channel.

9. The pump system of claim 6 wherein pressure of flowing fluid is reduced in the high velocity channel inhibiting damage to the at the least one piston seal.

10. The pump system of claim 1 further comprising a plugging prevention system above the discharge pump which receives pumped fluid with solids therein pumped by the discharge pump and which has a flow path oriented to inhibit solids flow down to the discharge pump.

11. The pump system of claim 1 further comprising pressure apparatus for returning the pumping piston and the pump plunger.

12. The pump system of claim 1 further comprising a first tubular in fluid communication with the pump system, a second tubular in fluid communication with the pump system, the first tubular adjacent the second tubular and located so that sufficient fluid pressure in the first tubular elongates the first tubular with respect to the second tubular, an isolation apparatus for isolating the pumping system from effects of elongation of the first tubular.

13. The pump system of claim 1 further comprising an outer barrel, the pump barrel within the outer barrel, and the pump barrel pre-loaded in compression against the outer barrel.

14. The pump system of claim 1 further comprising a surface power unit for providing power fluid to the pump system.

15. The new pump system of claim 1 further comprising the pumping piston having a piston exterior surface, the sealing system having a plurality of seals on the pumping piston for sealing an interface between the exterior surface of the pumping piston and an interior surface of the pump barrel.

16. A pump system for pumping fluid, the fluid containing solids, the pump system being a well deliquefication system, the pump system comprising a pump section with a fluid pump having a movable pump plunger for pumping fluid, the fluid in a wellbore and including water with solids therein, a discharge section with a discharge pump for receiving fluid pumped by the fluid pump, the discharge pump for pumping the fluid out from the pump system, the discharge pump having a pump barrel with an interior surface, the discharge pump having a pumping piston with a sealing system, the pumping piston movable in the pump barrel, the pumping piston having a top, a diffuser for facilitating fluid flow past the sealing system of the pumping piston, the diffuser comprising a body with a body inlet for receiving fluid pumped by the pumping system, the body connectible to the pumping piston, the body having a body outlet from which pumped fluid exits the body, a disc with a stem, the stem connected to the body, the disc diffusing fluid flow past the sealing system, the disc having a bottom surface and a top surface spaced-apart from the bottom surface, the disc having a disc top, the disc top having a disc top surface, the disc top surface being convex to facilitate flushing of solids from the disc top of the disc, the disc positioned so that fluid exiting from the body outlet exits the body outlet below the disc and the fluid exiting the body outlet is movable below the bottom surface of the disc and then past the sealing system, the disc having an outer edge spaced apart from the sealing system, a high velocity channel defined by defining parts comprising the outer edge of the disc and a portion of the interior surface of the pump barrel, the sealing system having at least one piston seal, and flow of fluid in the high velocity channel inhibiting damage of the at least one piston seal of the sealing system by the fluid.

17. A pump system for pumping fluid, the fluid containing solids, the pump system being a well deliquefication system, the pump system comprising a pump section with a fluid pump having a movable pump plunger for pumping fluid, the fluid in a wellbore and including water with solids therein, a discharge section with a discharge pump for receiving fluid pumped by the fluid pump, the discharge pump for pumping the fluid out from the pump system, the discharge pump having a pump barrel with an interior surface, the discharge pump having a pumping piston with a sealing system, the pumping piston movable in the pump barrel, the pumping piston having a top, the discharge pump having a discharge mandrel which receives fluid flowing past the diffuser, the discharge mandrel having a mandrel bottom surface adjacent the disc top surface of the disc top, the mandrel bottom surface being concave to facilitate flushing of solids from the disc top of the disc a diffuser for facilitating fluid flow past the sealing system of the pumping piston, the diffuser comprising a body with a body inlet for receiving fluid pumped by the pumping system, the body connectible to the pumping piston, the body having a body outlet from which pumped fluid exits the body, a disc with a stem, the stem connected to the body, the disc diffusing fluid flow past the sealing system, the disc having a bottom surface and a top surface spaced-apart from the bottom surface, the disc positioned so that fluid exiting from the body outlet exits the body outlet below the disc and the fluid exiting the body outlet is movable below the bottom surface of the disc and then past the sealing system, the disc having an outer edge spaced apart from the sealing system, a high velocity channel defined by defining parts comprising the outer edge of the disc and a portion of the interior surface of the pump barrel, the sealing system having at least one piston seal, and flow of fluid in the high velocity channel inhibiting damage of the at least one piston seal of the sealing system by the fluid.

18. A well deliquefication method for pumping fluid with solids therein from a wellbore using a pump system the method comprising pumping fluid with solids therein with a pump system, the pump system comprising a pump section with a fluid pump having a movable pump plunger for pumping fluid, the fluid with solids therein, a discharge section with a discharge pump for receiving fluid pumped by the fluid pump, the discharge pump for pumping the fluid out from the pump system, the discharge pump having a pump barrel with an interior surface, the discharge pump having a pumping piston with a sealing system, the pumping piston movable in the pump barrel, the pumping piston having a top, and a diffuser for facilitating fluid flow past the sealing system of the pumping piston, the diffuser comprising a disc, the disc having a disc top, the disc top having a disc top surface, the disc top surface being convex to facilitate flushing of solids from the disc top of the disc, pumping the fluid with solids therein to the diffuser, flowing the fluid with solids therein to the diffuser and thereby inhibiting damage of the piston seal by solids in the fluid, and with the diffuser, facilitating flushing of solids from the disc top of the disc.

* * * * *